US007617576B2

(12) United States Patent
Tanio

(10) Patent No.: US 7,617,576 B2
(45) Date of Patent: Nov. 17, 2009

(54) FASTENER AND ORNAMENT INCLUDING THE FASTENER

(75) Inventor: Yoshiyuki Tanio, Aichi-gun (JP)

(73) Assignee: Right Planning Ltd., Aichi (JP)

( * ) Notice: Subject to any disclaimer, the term of this patent is extended or adjusted under 35 U.S.C. 154(b) by 166 days.

(21) Appl. No.: 11/498,193

(22) Filed: Aug. 3, 2006

(65) Prior Publication Data

US 2008/0028580 A1 Feb. 7, 2008

(51) Int. Cl.
*A44C 7/00* (2006.01)

(52) U.S. Cl. ..... 24/705; 24/706.5; 24/706.9; 63/12; 63/13

(58) Field of Classification Search ..... None
See application file for complete search history.

(56) References Cited

U.S. PATENT DOCUMENTS 982,727 A * 1/1911 Jones ..... 24/706.9
3,523,339 A * 8/1970 Laviano ..... 24/706.6
5,170,542 A * 12/1992 Greenberg ..... 24/705

FOREIGN PATENT DOCUMENTS

| | | |
|---|---|---|
| JP | 58164515 | 11/1983 |
| JP | 304207 | 7/1997 |
| JP | 2000-50918 | 2/2000 |
| JP | 2000-125911 | 5/2000 |
| JP | 2001-17212 | 1/2001 |
| JP | 3178523 | 4/2001 |
| JP | 2005-204752 | 8/2005 |

* cited by examiner

*Primary Examiner*—Jack W. Lavinder
(74) *Attorney, Agent, or Firm*—Oliff & Berridge, PLC

(57) ABSTRACT

A pierced earring fastener 1 has: a pinching member 2 made of three balls 2*a*, 2*a*, 2*a*; a holder 3 that is a rubber-like elastic member; and a ring 5 for tightening the pinching member 2 and the holder 3. The three balls 2*a*, 2*a*, 2*a* are disposed in a ring shape at intervals of 120 degrees in a circumferential direction, as elements that form the pinching member 2. These balls are retained at predetermined positions by means of the holder 3. The holder completely surrounds the circular pinching member 2 formed by the three balls 2*a*. A through hole 3*a* penetrating a center of both of end faces 3*c*, 3*c* is formed via a gap 2*b* formed at the center of a ring formed by the pinching member 2 closed inside thereof.

9 Claims, 26 Drawing Sheets

FASTENER AND ORNAMENT INCLUDING THE FASTENER

RELATED APPLICATION

This application incorporates Japanese Patent Application No. 2004-012452 filed on Jan. 20, 2004 herein by reference.

BACKGROUND OF THE INVENTION

1. Field of the Invention

The invention relates to a fastener for use in an ornament that includes the fastener.

2. Description of the Related Art

Conventionally, in a fastener for use in an ornament, for example, in a pierced earring fastener (pierced earring fastener), a silicone rubber having rubber elasticity is formed in a cylindrical shape, a spherical shape, or a semispherical shape and the like, and a through hole is provided along a center axis thereof. In such a pierced earring fastener, after a shaft-shaped pin of a pierced earring has been inserted into an earlobe, the pin is inserted into a through hole of the pierced earring fastener, and is used as a pierced earring fastener. However, because the silicone rubber is soft, there has been a problem that a pinching force of the fastener is lost within a short period of time; and the fastener is lost or cannot be used properly. Therefore, the Inventor proposed a fastener such as a pierced earring fastener formed by covering a spherically or cylindrically-shaped pinching member for pinching the pin of the pierced earring with a rubber-like member (refer to patent document 1).

Patent Document 1

Japanese Patent Application Laid-open No. 2000-125911

According to the fastener disclosed in patent document 1, pinching capability of a pin (pinched portion) can be continuously maintained, and predetermined advantageous effect have been successfully attained in improvement of durability. However, the rubber-like elastic member is easily expanded due to aging. Therefore, there is a risk that the pinching capability of the pin is lowered, and the fastener drops. Such aging can occur, of course, when mounting and demounting actions are repeated, and even while the pin is inserted in the through hole and maintained there.

SUMMARY OF THE INVENTION

It is an object of the invention to provide a fastener and an ornament, the fastener being capable of restricting lowering of pinching capability of a pinched portion due to aging of a rubber-like elastic member, and promoting further improvement of durability, the ornament including the fastener.

In order to solve the above described problem, according to a first aspect of the present invention, there is provided a fastener comprising: a rubber-like elastic member that is formed essentially of a rubber or a soft synthetic resin, the elastic member being elastically deformable; and a restraining member that is capable of binding elastic deformation of the rubber-like elastic member in a state in which at least a part of the periphery of the rubber-like elastic member is surrounded, the restraining member having hardness which is equal to or greater than that of the rubber-like elastic member, wherein a part of an ornament is pinched by the rubber-like elastic member, thereby binding and retaining the ornament.

According to such a fastener, a part (pinched portion) of an ornament is pinched by a rubber-like elastic member; elastic reactive force (i.e., spring constant) is enhanced by a restraining force of a restraining member, whereby an ornament can be bound and retained by the thus enhanced elastic reactive force. In this manner, the lowering of the pinching capability of the pinched portion due to aging of the rubber-like elastic member is suppressed by means of the restraining members making it possible to improve durability. The rubber-like elastic member and the restraining member can be configured integrally by means of two-color molding, for example.

In order to solve the above described problem, according to a second aspect of the present invention, there is provided a fastener comprising: a rubber-like elastic member that is formed essentially of a rubber or a soft synthetic resin, the elastic member being elastically deformable; a pinching member that is harder than the rubber-like elastic member, the pinching member being retained at a predetermined position so as to be enveloped by the rubber-like elastic member in a state in which at least a part is embedded in the rubber-like elastic member, the pinching member capable of moving in an expanding direction with elastic deformation of the rubber-like elastic member; and a restraining member that is capable of restricting movement of the pinching member in an expanding direction and elastic deformation of the rubber-like elastic member, the elastic deformation being caused by such movement, in a state in which at least a part of the periphery of the rubber-like elastic member is surrounded, the restraining member having hardness which is equal to or greater than that of the rubber-like elastic member, wherein a part of an ornament is pinched by the rubber-like elastic member, thereby binding and retaining the ornament.

According to such a fastener, a part (pinched portion) of an ornament is pinched by a pinching member; movement of the pinching member is limited by means of a restraining force of the restraining member; and elastic reactive force (i.e., spring constant) is enhanced by means of a restraining force of a restraining member, whereby an ornament can be bound and retained by means of the thus enhanced elastic reactive force. In this manner, the lowering of the pinching capability of the pinched portion due to aging of the rubber-like elastic member is suppressed by means of the restraining member, making it possible to improve durability.

In these fasteners, a part of the ornament is formed as a shaft-shaped member so that the restraining member can cover the rubber-like elastic member to be surrounded along a circumferential direction of the shaft-shaped member. In this manner, the shaft-shaped member such as a pin is indirectly tightened by means of the restraining member via the rubber-like elastic member (or via the rubber-like elastic member and the pinching member) so that the pinching capability is maintained over a long period of time, and the durability of the fastener is improved.

At this time, if the restraining member covers the rubber-like elastic member in a ring shape, the rubber-like elastic member binds all of elastically deformable directions so that the shaft-shaped member can be pinched evenly in a circumferential direction. Therefore, in the case where the rubber-like elastic member has a through hole or a bottomed hole that permits insertion of the shaft-shaped member, the wear of these holes can be homogenized.

As described above, the restraining member is formed of a material having hardness equal to or greater than that of the rubber-like elastic member, for example, a metal (14KP gold, for example), a resin, or a hard rubber and the like. In addition, the restraining member has a function of pinching (tightening) a part (pinched portion such as a shaft-shaped member) of an ornament via the rubber-like elastic member (or via the rubber-like elastic member and a pinching member). Therefore, if the minimum inner diameter of a ring-shaped restraining member is formed to be smaller than the maximum outer diameter of the rubber-like elastic member, the restraining member can be prevented from coming off of the rubber-like elastic member or the restraining member can be firmly tightened and retained with the rubber-like elastic member, like a tightening engagement.

In addition, when the pinching member is comprised of a plurality of elements, a part of an ornament is directly pinched between elements of the pinching member or is indirectly pinched via another member. In addition, the elastic reactive force of the rubber-like elastic member is enhanced by means of the restraining force of the restraining member and movement of the pinching member is limited by means of the thus enhanced elastic reactive force so that the ornament can be bound and retained. At this times when a plurality of elements of the pinching member are arranged in parallel in a state in which two cylinders are coupled integrally with each other or in a state in which they are independent of each other, a part of the ornament is pinched in a gap defined between the cylinders of the pinching member; the elastic reactive force of the rubber-like elastic member is enhanced by limiting movement of the pinching member by means of the restraining force of the restraining member so that the ornament can be bound and retained by thus enhanced elastic reactive force.

In this way, the pinching member is made of a material that is harder than the rubber-like elastic member (for example, a metal), and is provided as a member for pinching a part of the ornament between the elements. For example, a spherical body, a columnar body, a modified spherical body having a plane provided partly of the spherical body, and other variously formed elements are assembled and formed so as to be proximate to each other.

In addition, the rubber-like elastic member is provided as a member for directly imparting an elastic force for binding a part of the ornament or for indirectly imparting the force via a pinching member. For example, this elastic member has a through hole or a bottomed hole that permits insertion of a part of the ornament, and is formed of a material having rubber elasticity such as silicone rubber, urethane rubber, acrylic rubber or the like. Also for example, when a pierced earring pin (shaft) is inserted while shifting a position of the pinching member and expanding the hole, an elastic reactive force is applied to an orientation such that the pinching member is restored at its predetermined position, and then, the pin is indirectly pinched via the pinching member. At this time, an expanding portion serving as an introducing portion may be provided at an end of a hole for inserting the pin. Further, when that hole is formed as a bottomed hole, a distal end of the pin is protected by means of the rubber-like elastic member and the distal end of the pin does not protrude, so that the appearance is improved and no contacts to human body occur. In addition, in the case where this hole is formed as a through hole, the top and bottom of the fastener cannot be discriminated, and there is no need of confirmation of the top and bottom at the time of wearing. Thus, the fastener can easily be used. In addition, the fastener is formed to be large sized, so as to be used with a chain being inserted as a necklace fastener or the like. Further, the rubber-like elastic member can be formed of a perspective, for example, transparent or semi-transparent material so that a pinching member, at least a part of which is embedded therein, can be externally positively viewed. In this manner, ornament property can be improved.

In addition, in order to solve the above described problem, according to a third aspect of the present invention, there is provided an ornament comprising; a fastener configured as described above; a main body; and a pinched portion to be pinched by means of the fastener at the main body side thereof.

As described above, there can be provided a further high quality ornament capable of preventing a loss of a fastener, improving durability of the whole ornament, and achieving a further high quality by the improvement of durability of the fastener.

In such an ornament, an auxiliary ornament member other than a main body and/or an auxiliary fixing member other than a fastener can be mounted on a restraining member of the fastener. In the case where the auxiliary ornament member is mounted on the restraining member of the fastener, an ornament effect (for example, a back pierced earring mode) can be added to the fastener in addition to the ornament effect of the main body (for example, front pierced earring mode). Further, in the case where the auxiliary fixing member is mounted on the restraining member of the fastener, a loss expensive jewelry or the like mounted as an auxiliary ornament member can be prevented. A method for mounting an auxiliary ornament member and/or an auxiliary fixing member on a restraining member of a fastener can include means such as brazing, adhesive bonding, or engagement with a recessed portion. Specifically, the restraining member of the fastener can have a mounting portion (such as a hook) for mounting an auxiliary ornament member other than the main body and/or an auxiliary fixing member other than the fastener. In this way, as long as the restraining member of the fastener has a mounting portion such as a hook, these auxiliary ornament member and auxiliary fixing member can be easily mounted. The mounting portion is composed of a material identical to that for the restraining member. After the fastener has been assembled, the mounting portion can be fixed by being brazed with the restraining member positioned at the outermost part or by other method.

The ornament used here includes a pierced earring, an unpierced earring, a broach, a necklace, a bracelet, or an anklet and the like. A relationship between a main body and a fastener in an ornament according to the present invention can be expressed as follows:

(1) In a pierced earring or a broach and the like, a pierced earring fastener (pierced earring fastener) or a broach fastener may have an essential function of a fastener for fastening a shaft-shaped member of a main body through an earlobe or fabric on the back or may have a function of mounting an auxiliary ornament member or an auxiliary fixing member on the main body.

(2) In an unpierced earring or the like, an unpierced earring fastener is used in the case where it has a function of mounting an auxiliary ornament member or an auxiliary fixing member on a main body instead of a function for retaining the main body of the unpierced earring on an ear.

(3) Fasteners of a necklace, a bracelet, or an anklet and the like have a function of folding a string-like chain to be halved, both ends of which are inserted to form a ring; moving a position against the chain of a main body to be slid; and adjusting the size of the ring.

BEST MODE FOR CARRYING OUT THE INVENTION

First Embodiment

Figure 1A:
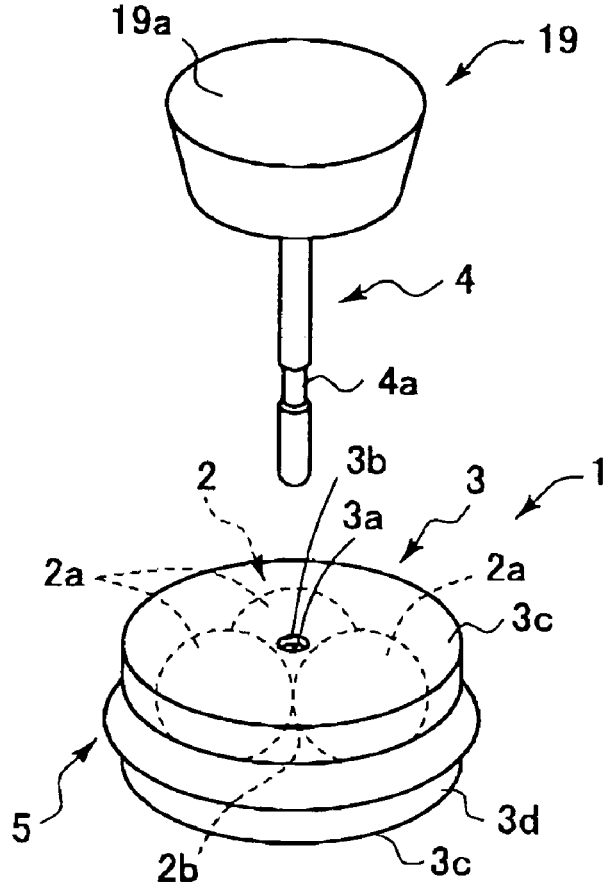
FIG. 1A is a perspective view showing a first embodiment of a pierced earring fastener serving as a fastener according to the present invention and a pierced earring serving as an ornament.
Figure 1B:
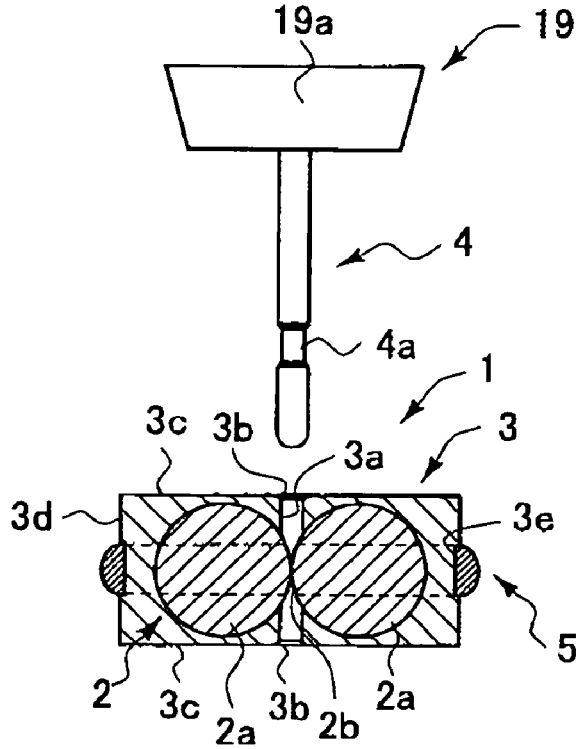
FIG. 1B is a front view showing a partial cross section of the first embodiment of the pierced earring fastener serving as a fastener according to the present invention and a pierced earring serving as an ornament.

Now, embodiments of the present invention will be described with reference to some examples shown in the accompanying drawings. FIG. 1A and FIG. 1B each show a first embodiment of each of a pierced earring fastener serving as a fastener according to the present invention and a pierced earring as an ornament. A pierced earring fastener 1 (fastener) comprises: a pinching member 2 comprised of three (a plurality of) balls 2*a*, 2*a* and 2*a*; a ball holder (holder) 3 that is a rubber-like elastic member; and a ring 5 (restraining member) for tightening the pinching member 2 and the holder 3.

The three balls 2*a*, 2*a* and 2*a* are disposed in a ring shape at intervals of 120 degrees in a circumferential direction, as elements constituting the pinching member 2. These balls are retained at their predetermined positions by means of the holder 3. The ball 2*a* is formed in a spherical shape, of a hard metal material (for example, stainless steel). The holder 3 is formed in a cylindrical shape, of a material having rubber elasticity such as silicone rubber. This holder completely surrounds the ring-shaped pinching member 2 constituted by the three balls 2*a*. A through hole 3*a* penetrating the center of both of end faces 3*c* and 3*c* is formed via a gap 2*b* defined at a center of the ring made by the pinching member 2 contained therein. In the vicinity of each of the ends of the through hole 3*a*, an introducing portion 3*b* each expanding the diameter in a tapered shape is formed toward each of the end faces 3*c*, thereby guiding insertion of a shaft-shaped member included in an ornament such as a pierced earring pin or a broach pin. The ring 5 is made of metal material (for example, 14KP gold) that is harder than the holder 3 and is formed into a ring shape. This ring binds from outside the movement in an expanding direction (radial direction) of the pinching member 2 (balls 2*a*, 2*a* and 2*a*) and elastic deformation of the holder 3 due to that movement. In this manner, the ring 5 covers externally in a ring shape the periphery in a radial direction in which the holder 3 is elastically deformable.

In a pierced earring 19 (main body), an ornament portion 19*a* is formed integrally with a proximal end of a shaft-shaped pin 4. (shaft-shaped member or pinched portion). The pierced earring fastener 1 is inserted through a proximal end side of the pin 4, and pinches the pin 4 in a state in which the fastener is engaged with a peripheral groove 4*a* formed in the vicinity of a distal end thereof. At this time, by means of the restraining force of the ring 5, movement of the pinching member 2 is limited, and then, the elastic reactive force of the holder 3 is enhanced. In this manner, the pin 4 of the pierced earring 19 is bound and retained by means of the thus enhanced reactive force, and then, the pin 4 is pinched between the balls 2*a*, 2*a* and 2*a*. As shown in FIG. 1B, the minimum inner diameter of the ring 5 is formed to be smaller than the maximum outer diameter of the holder 3. In the insertion direction of the pin 4, a width of the ring 5 is formed to be smaller than that of the holder 3 so that the ring 5 hardly comes off an engagement groove 3e defined on a circumferential face of the holder 3 and the holder 3 and the pinching member 2 are strongly tightened externally.

In the pierced earring fastener 1, while the holder 3 for binding the pinching member 2 in a covering state may be colored with appropriate color, the pinching member 2 embedded therein can be viewed in a perspective manner if the fastener is transparent or semitransparent. Thus, an ornamental value can be added to the fastener 1 by beauty in terms of the design, that is, the shape of the element 2*a* of the pinching member 2 and its assembled mode.

Here, effects (function) of the pierced earring fastener 1 will be described with reference to FIG. 2. As shown in steps (a) and (b) of FIG. 2, a distal end of the shaft-shaped pin 4 of the pierced earring 19 is inserted into the through hole 3*a* via the introducing portion 3*b*. In order to expand the gap 2*b*, while the ball 2*a* is moved in an expanding direction, the pin 4 is advanced straight inside of the through hole 3*a*. Concurrently, the holder 3 is pushed to be expanded, and a side face 3*d* is about to protrude to the outside. Namely, the balls 2*a* moves to the outside in a radial direction (indicated by the arrow in step (b)), whereas the holder 3 is elastically deformed.

Figure 2:
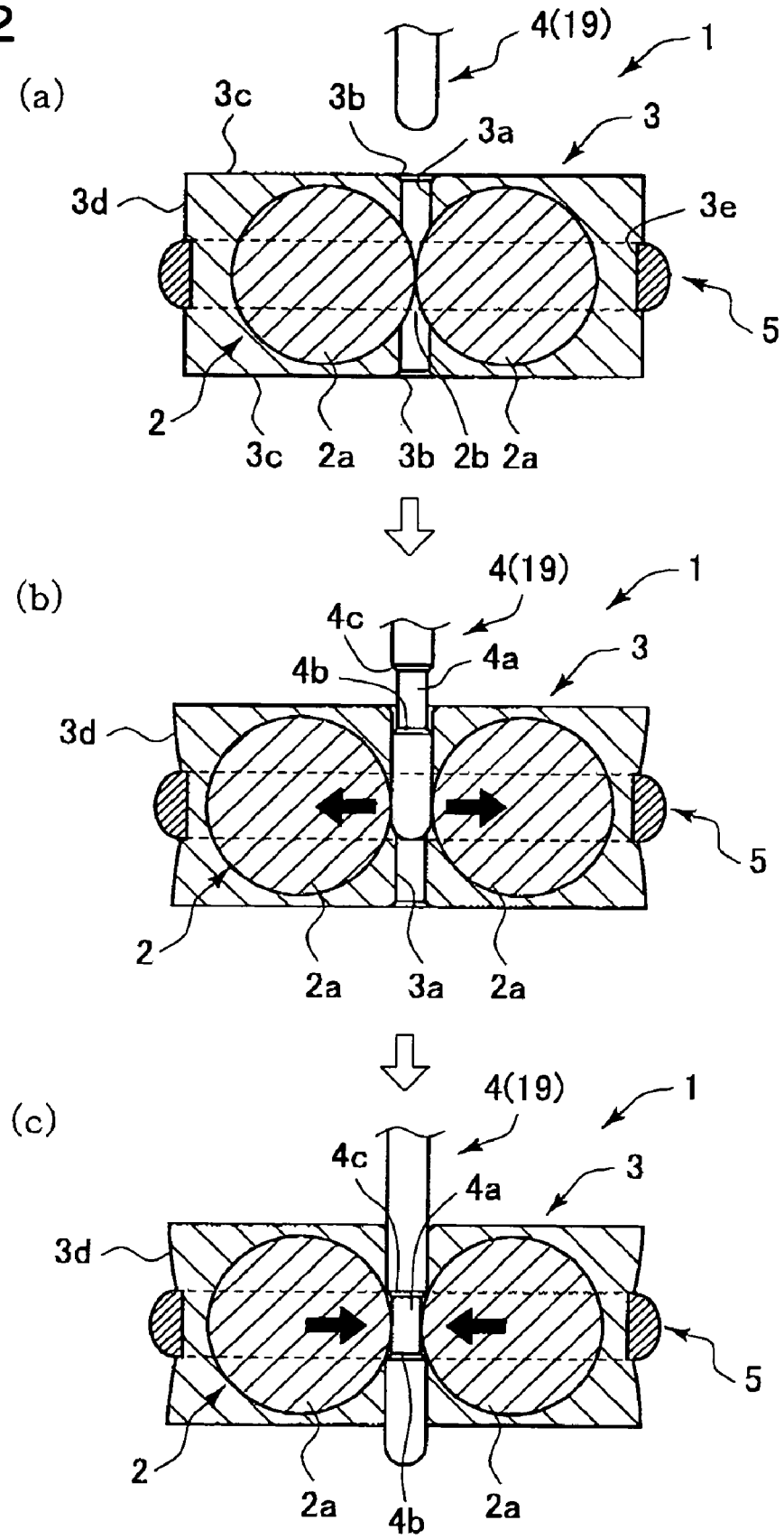
FIG. 2 is a frontal cross section showing a function of the pierced earring fastener shown in FIG. 1B.

At this time, as shown in step (c) of FIG. 2, the ring 5 serves to restrict movement of the balls 2*a* by means of its restraining force and to improve a spring constant (elastic reactive force) obtained when the holder 3 is elastically restored by means of a reaction. By the thus enhanced elastic reactive force (reaction force), the holder 3 compresses and pinches in a state in which it surrounds the pin 4 via each of the balls 2*a* (as indicated by the arrow in step (c)). In the pin 4, the small diameter portion (circumferential groove) 4*a* is defined at a pinched portion thereof, and then, such balls 2*a* pinch the pin 4 in a state that each of the balls 2*a* is engaged with this circumferential groove 4*a*. Namely, after a distal end of the pin 4 has advanced to push the three balls 2*a* in a expanding direction, if the circumferential groove 4*a* reaches a pinching portion of the three balls 2*a*, these three balls 2*a* slightly return in a diameter-reducing direction, and stays in the circumferential groove 4*a*. In this manner, the pin 4 is positioned and pinched. Here, stepped portions 4*b* and 4*c* at both sides of the circumferential groove 4*a* function to position the pin 4. In particular, 4*b* serves to prevent the pin 4 from coming-off of the three balls 2*a*.

In addition, the introducing portion 3*b* provided at each end of the through hole 3*a* formed at the holder 3 may be formed in a curved shape instead of forming it to be expanded in a diameter direction in a tapered shape. One end or both ends of the through hole 3*a* can be formed without being expanded in a diameter direction. The shape of the ends of such a through hole 3*a* is applicable to all of the embodiments which will be described later. However, as shown in FIG. 2, in the case of the pierced earring fastener 1 used as a pierced earring fastener, it is desirable to provide the introducing portion 3*b* for guiding the pin 4 at each end of the through hole 3*a* so that the pin 4 can easily be inserted through both sides regardless of the top and back.

Figure 3:
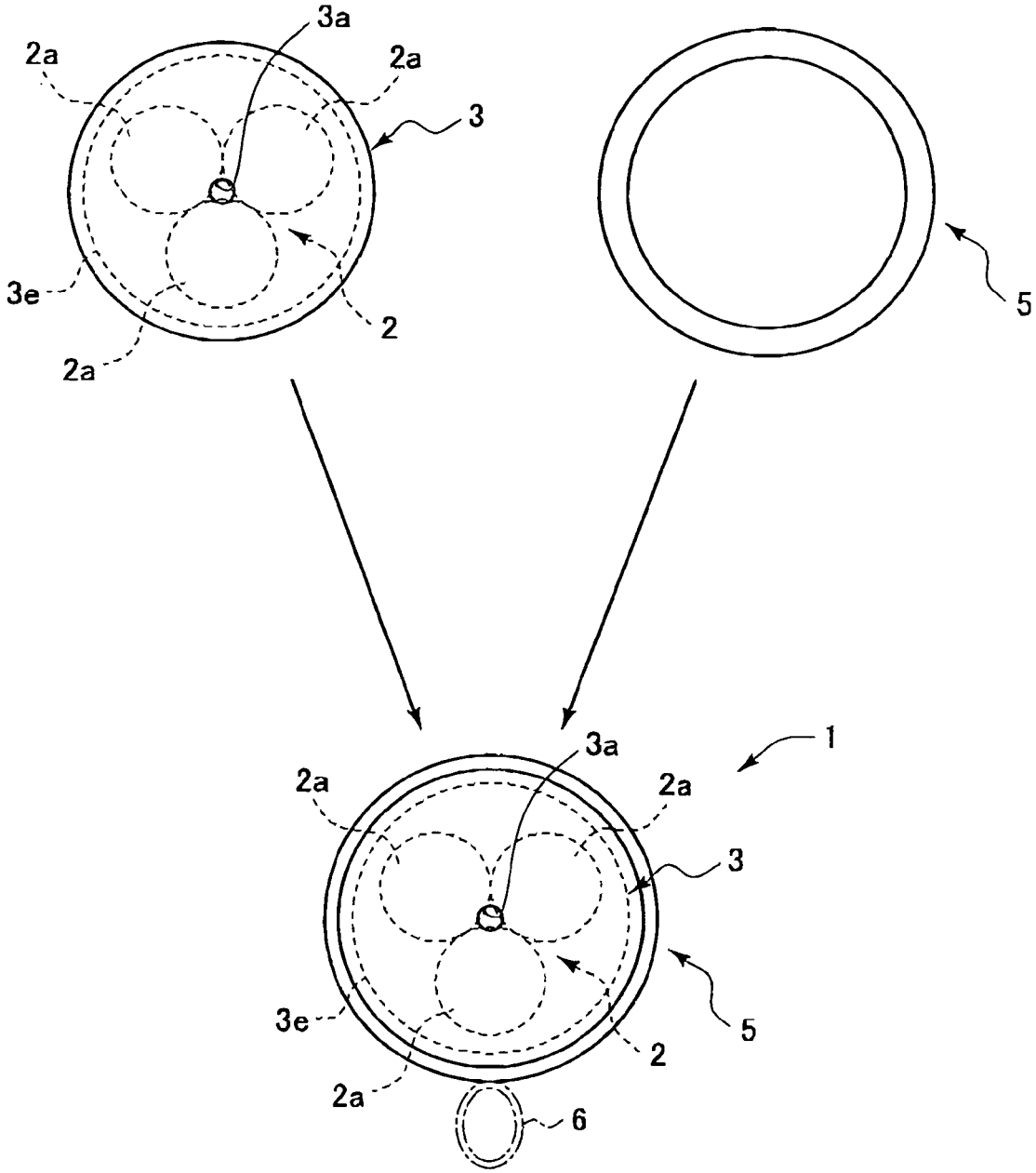
FIG. 3 is an illustrative view illustrating a method for manufacturing the pierced earring fastener shown in FIG. 1A.

FIG. 3 shows a method for manufacturing such pierced earring fastener 1. As shown in FIG. 3, the three balls 2*a*, 2*a* and 2*a* (pinching member 2) are inserted into a die, and then, a silicone rubber is injected and insertion-molded, thereby forming the holder 3 that has the through hole 3*a* in an axial direction and the engagement groove 3*e* on a circumferential face. In addition, the circularly annular ring 5 is cut and formed. Next, when an inner periphery face of the ring 5 is engaged into the engagement groove 3*e* of the holder 3, the pierced earring fastener 1 is completed.

Figure 17A:
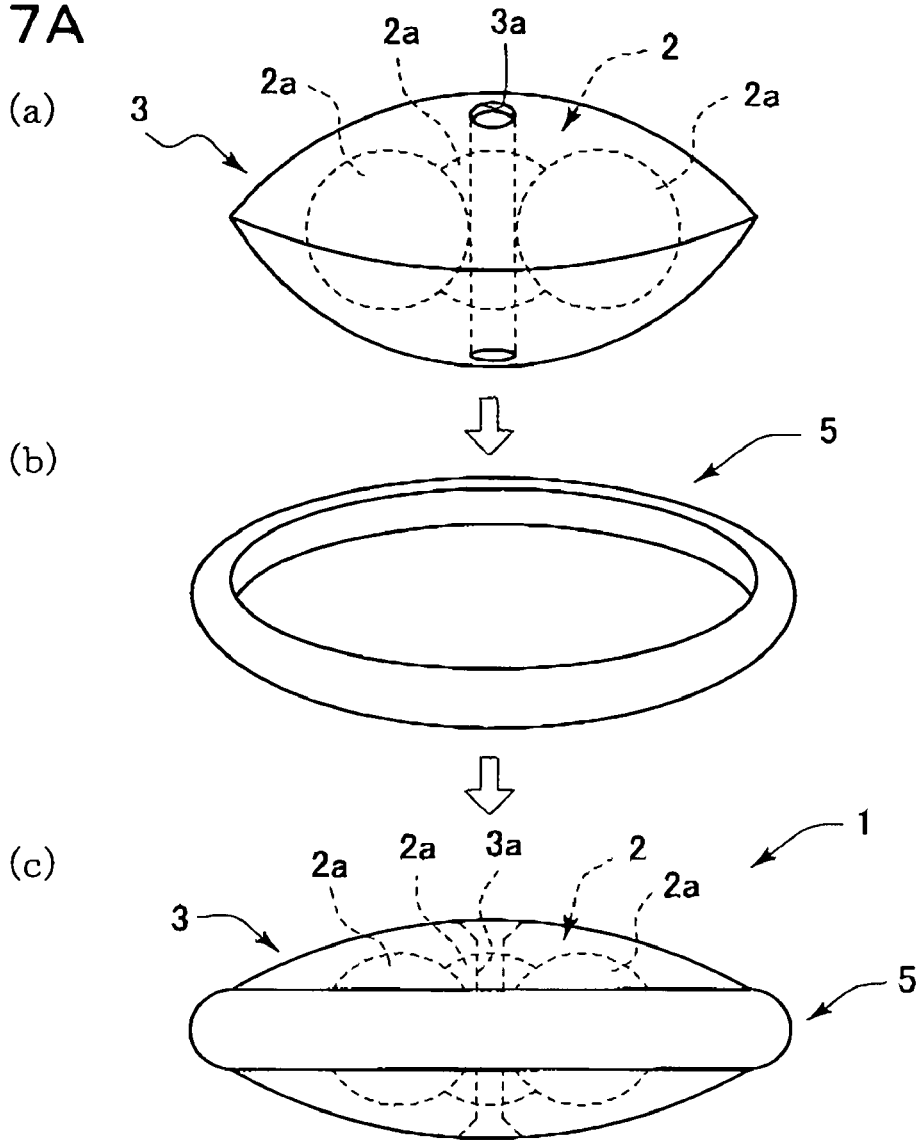
FIG. 17A is an illustrative process flow chart illustrating a modified example of FIG. 3.
Figure 17B:
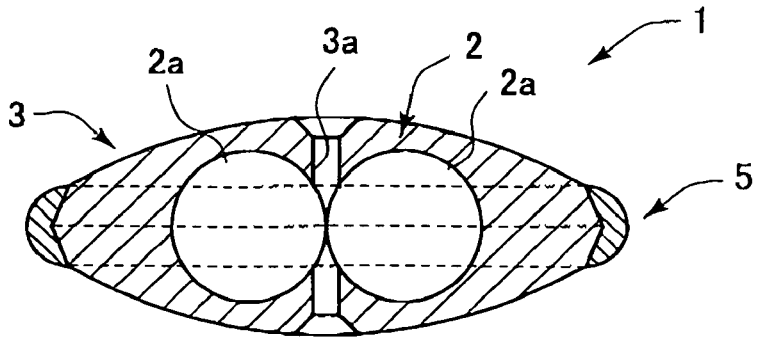
FIG. 17B is a frontal cross section of a pierced earring fastener manufactured in FIG. 17A.

FIG. 17A and FIG. 17B each show a modified example of FIG. 3. As shown in step (a) of FIG. 17A, the three balls 2*a*, 2*a* and 2*a* (pinching member 2) are inserted into a die, and then, a silicone rubber is injected and insertion-molded. In this manner, the holder 3 (rubber-like elastic member) is formed, the holder having the through hole 3*a* in an axial direction and exhibiting a lens shape the center part of which is thick and a peripheral part of which is thin. In addition, the circularly annular ring 5 as shown in step (b) of FIG. 17A is formed by means of cutting or the like. At this time, a cross section of the ring 5 is formed into a protrusive mountain-like shape (inverted V-shape) toward the outside, and the minimum inner diameter of the ring 5 is formed to be smaller than the maximum outer diameter of the holder 3 (refer to FIG. 17B). Next, as shown in step (c) of FIG. 17A, the holder 3 is engaged so that an outer face of the holder 3 can be received on the mountain-shaped inner periphery face of the ring 5, and the pierced earring fastener 1 is completed.

Second Embodiment

Figure 4A:
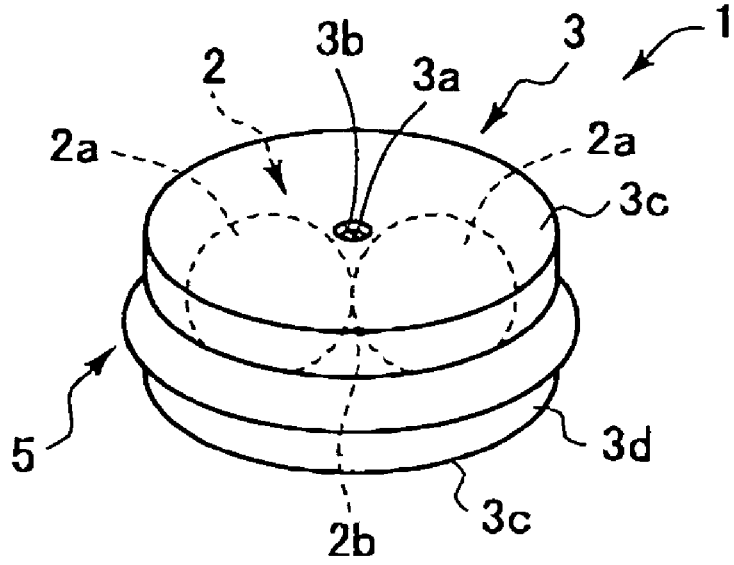
FIG. 4A is a perspective view showing a second embodiment of the pierced earring fastener.
Figure 4B:
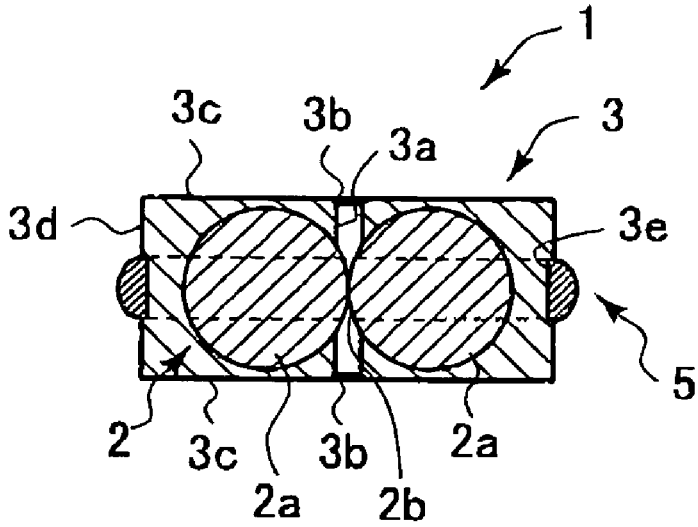
FIG. 4B is a frontal cross section showing a second embodiment of the pierced earring fastener.

FIG. 4A and FIG. 4B each show a second modified example of a pierced earring fastener. In FIG. 4A and FIG.

4B, the pinching member 2 is comprised of the two balls 2*a* and 2*a* opposed to each other in a circumferential direction at an interval of 180 degrees.

Third Embodiment

Figure 5A:
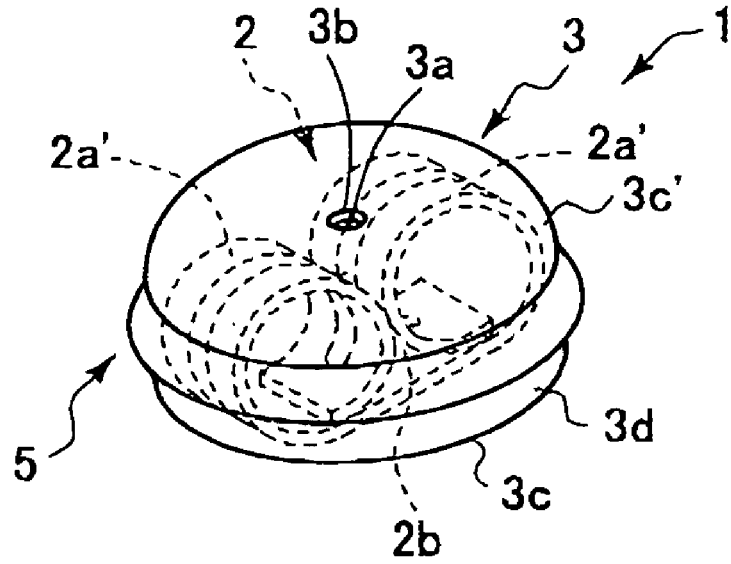
FIG. 5A is a perspective view showing a third embodiment of a pierced earring fastener.
Figure 5B:
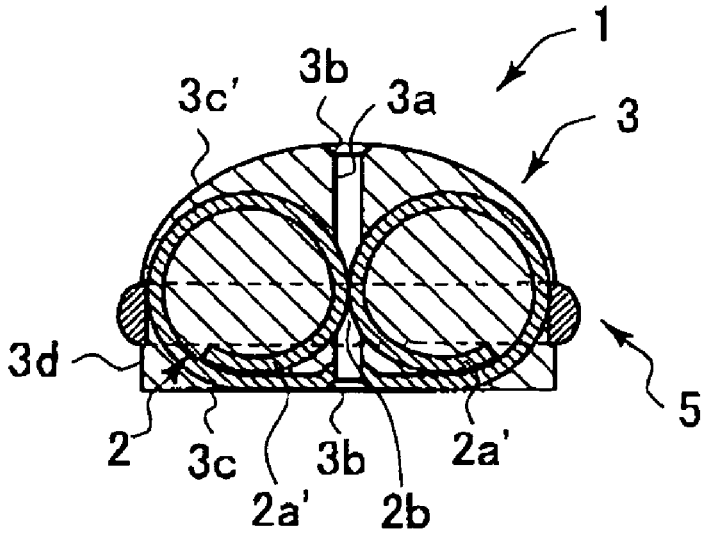
FIG. 5B is a frontal cross section showing the third embodiment of the pierced earring fastener.

FIG. 5A and FIG. 5B each show a third embodiment of a pierced earring fastener. In FIG. 5A and FIG. 5B, the pinching member 2 is comprised of two cylinder bodies 2*a*' and 2*a*' integrally coupled with each other. At the time of insertion molding of the holder 3, silicone rubber is filled inside of the cylinder bodies 2*a*' and 2*a*'. In addition, an upper end face 3*c*' of the holder 3 is formed into an upwardly protrusive dome shape. In the second embodiment (FIG. 4A and FIG. 4B) and the third embodiment (FIG. 5A and FIG. 5B), constituent elements having functions common to those of the first embodiment (FIG. 1A to FIG. 3) are designated by the same reference numerals, and the descriptions are omitted.

Fourth Embodiment

Figure 6A:
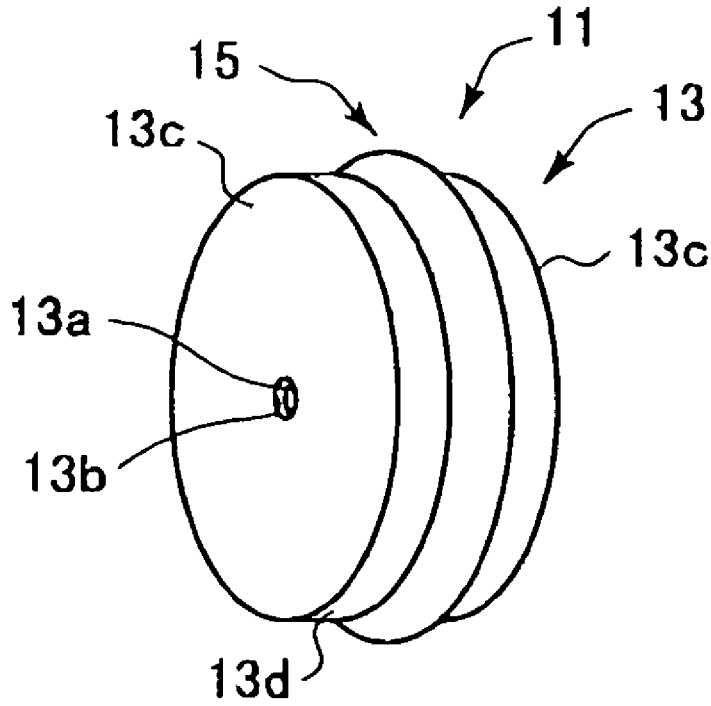
FIG. 6A is a perspective view showing a fourth embodiment of a pierced earring fastener.
Figure 6B:
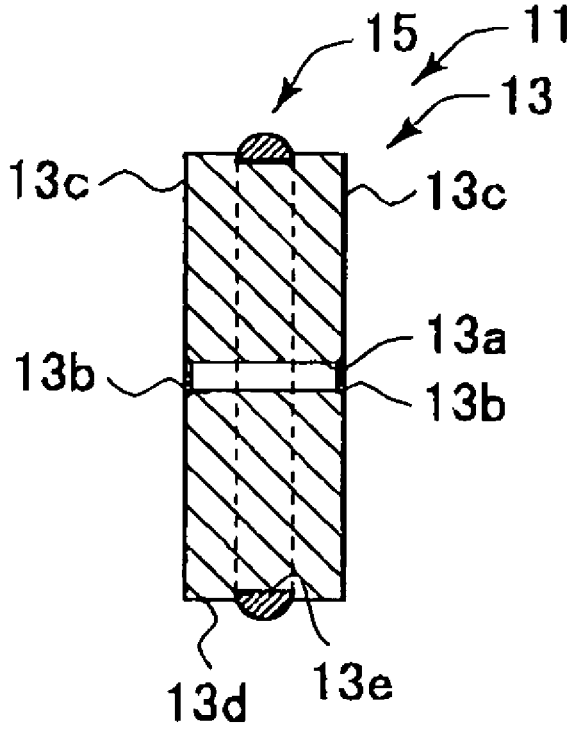
FIG. 6B is a frontal cross section showing the fourth embodiment of the pierced earring fastener.

FIG. 6A and FIG. 6B each show a fourth embodiment of a pierced earring fastener. A pierced earring fastener 11 (fastener) shown in FIG. 6A and FIG. 6B is equipped with: the ball holder (holder) 13 that is a rubber-like elastic member; and a ring 15 (restraining member) for restraining the holder 3. This pierced earring fastener is not equipped with the pinching member 2 of the first embodiment (FIG. 1A and FIG. 1B).

The holder 13 is formed in a cylindrical shape, of a material having rubber elasticity such as of a silicone rubber, for example, and the through hole 13*a* penetrating a center of both of the end faces 13*c* and 13*c* is formed. The introducing portion 13*b* expanding the diameter in a tapered shape toward each of the end faces 13*c* is formed in the vicinity of each end of the through hole 13*a*, thereby guiding insertion of an axial member included in an ornament such as a pierced earring pin or a broach pin. The ring 15 is made of a metal material (for example, 14KP gold) that is harder than that of the holder 13 and formed in an annular shape, and binds elastic deformation of the holder 13 from outside. In this manner, the ring 15 externally covers in an annular shape the periphery in a radial direction in which the holder 13 is elastically deformable. Therefore, an elastic reactive force of the holder 13 is enhanced by means of a restraining force of the ring 15, and a pin 4 (refer to FIG. 1A) of the pierced earring 19 is bound and retained. Then, the pin 4 is pinched by means of the holder 13.

Fifth Embodiment

Figure 7A:
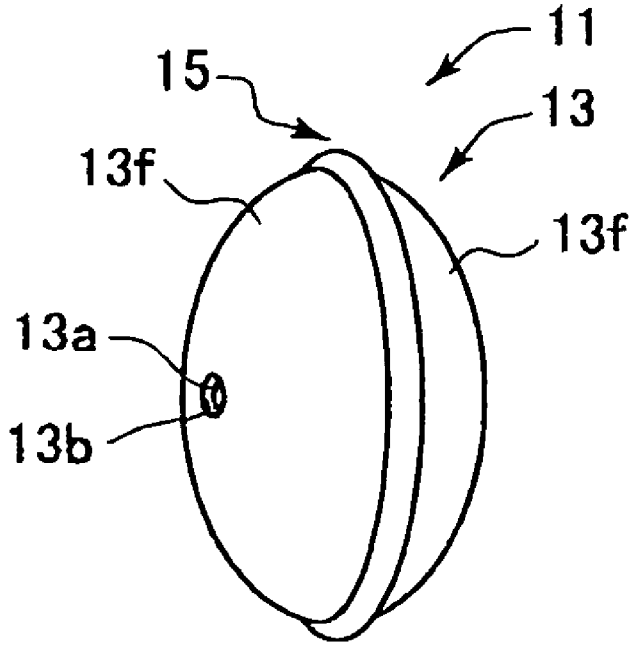
FIG. 7A is a perspective view showing a fifth embodiment of a pierced earring fastener.
Figure 7B:
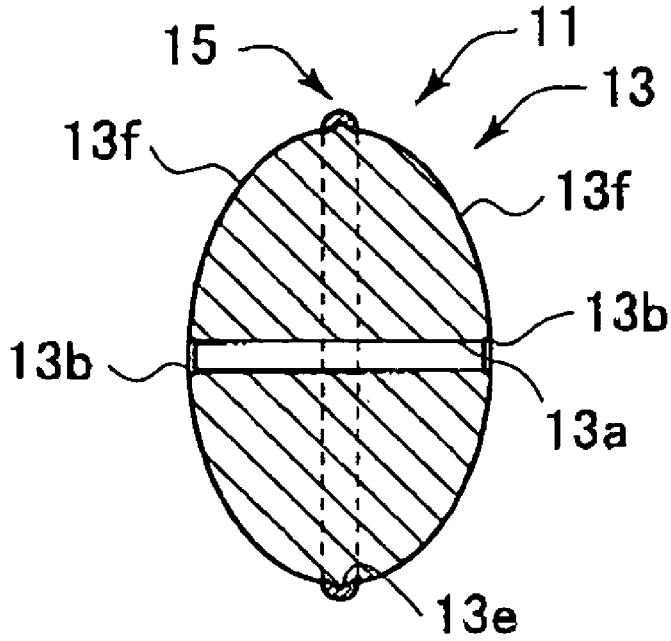
FIG. 7B is a frontal cross section showing the fifth embodiment of the pierced earring fastener.

FIG. 7A and FIG. 7B each show a fifth embodiment of a pierced earring fastener. In FIG. 7B, a sectional shape of the holder 13 is formed in an elliptical shape made of the two curved faces 13*f* and 13*f*. In addition, a sectional shape of the ring 15 is formed in a protrusive mountain-like shape (inverted V-shape) toward the outside.

Sixth Embodiment

Figure 8A:
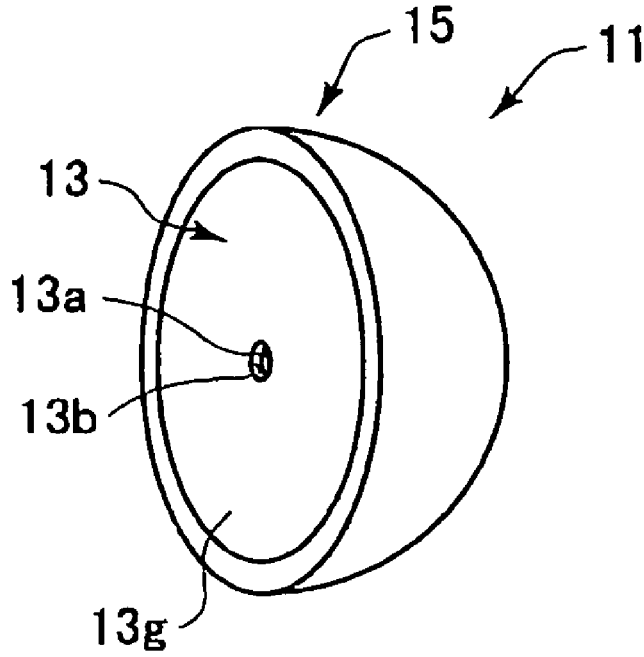
FIG. 8A is a perspective view showing a sixth embodiment of a pierced earring fastener.
Figure 8B:
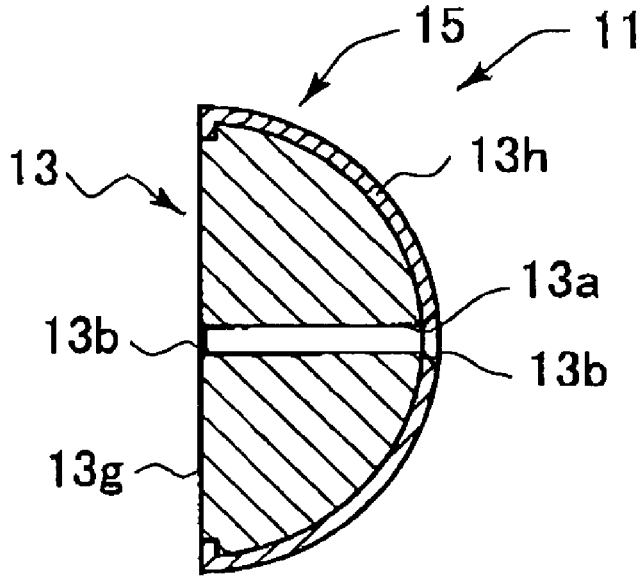
FIG. 8B is a frontal cross section showing the sixth embodiment of the pierced earring fastener.

FIG. 8A and FIG. 8B each show a sixth embodiment of a pierced earring fastener. In FIG. 8A and FIG. 8B, the holder 13 is formed in a semispherical shape (whose sectional shape is formed in a semispherical shape). In addition, the ring 15 externally covers in an annular shape the full face of the semispherical face 13*h* of the holder 13 and the full circumference of the peripheral rim of the end face 13*g*. Therefore, the ring 15 fully restrains the directions in which the holder 13 is elastically deformable.

Seventh Embodiment

Figure 9A:
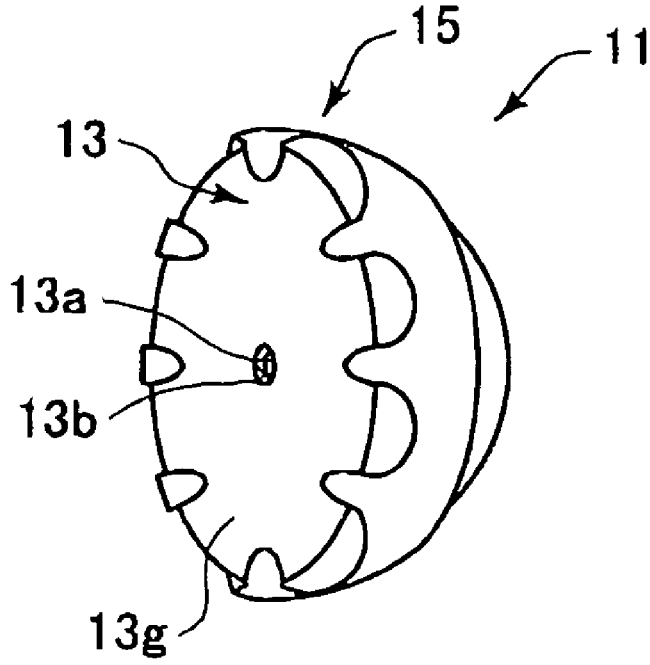
FIG. 9A is a perspective view showing a seventh embodiment of a pierced earring fastener.
Figure 9B:
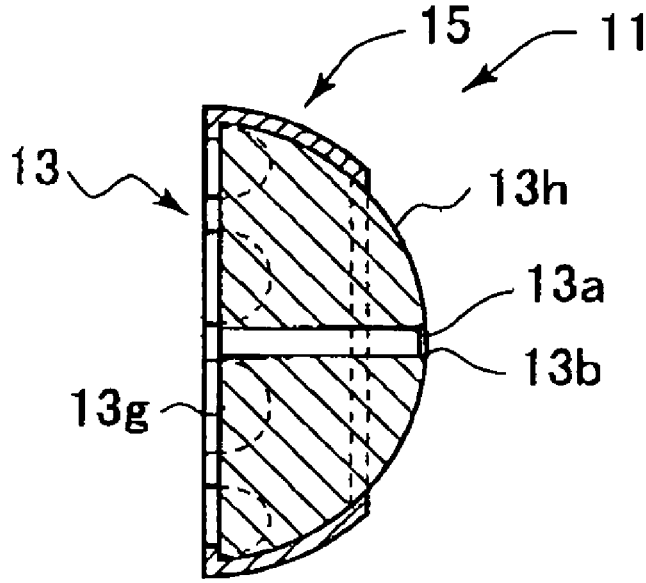
FIG. 9B is a frontal cross section showing the seventh embodiment of the pierced earring fastener.

FIG. 9A and FIG. 9B each show a seventh embodiment of a pierced earring fastener. In FIG. 9A and FIG. 9B, the ring 15 externally covers in an annular shape a partial face of the semispherical face 13*h* of the holder 13 and a part of the peripheral rim of the end face 13*g*. In the fifth embodiment (FIG. 7A and FIG. 7B), the sixth embodiment (FIG. 8A and FIG. 8B), and the seventh embodiment (FIG. 9A and FIG. 9B), constituent elements having functions common to those of the fourth embodiment (FIG. 6A and FIG. 6B) are designated by the same reference numerals, and the descriptions are omitted.

Figure 10A:
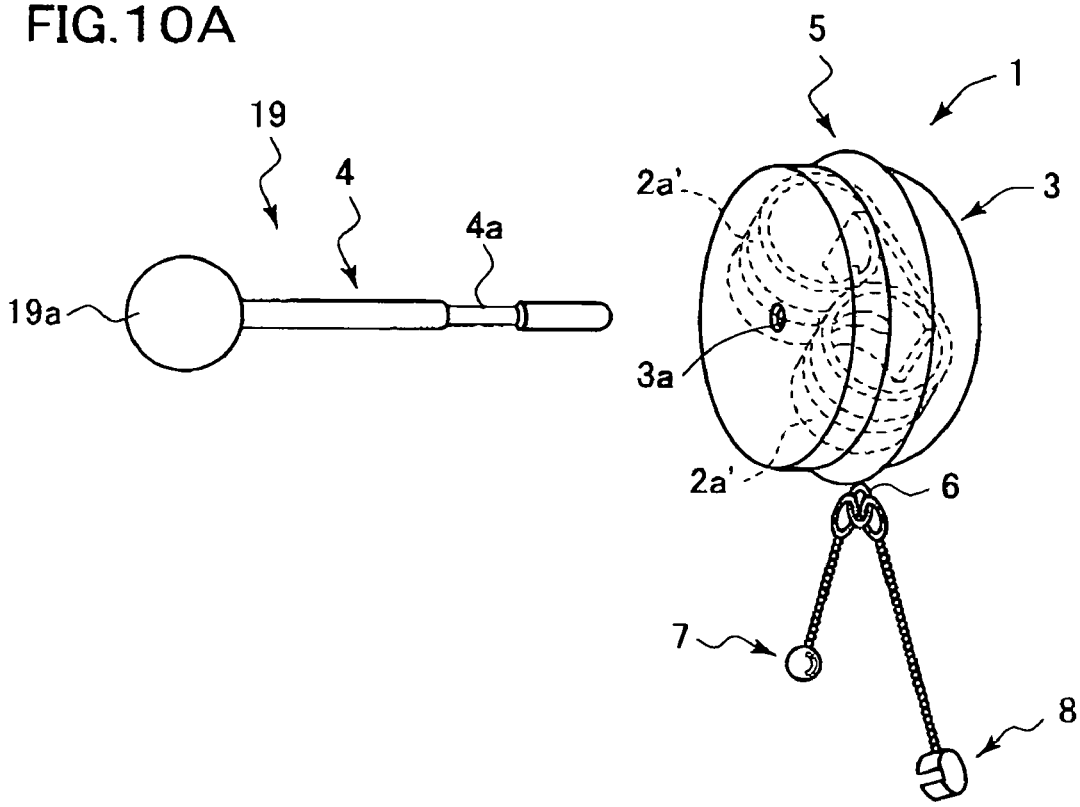
FIG. 10A is an illustrative perspective view illustrating a first use example of a pierced earring serving as an ornament according to the present invention.
Figure 10B:
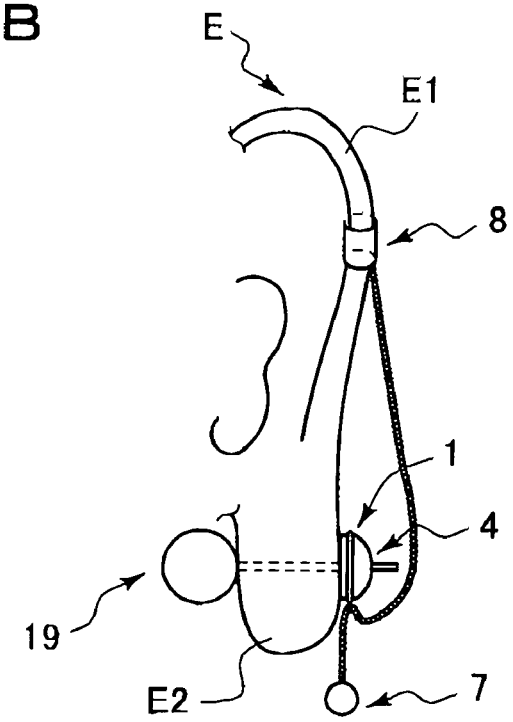
FIG. 10B is an illustrative view of wearing showing the first use example of the pierced earring serving as the ornament according to the present invention.

FIG. 10A and FIG. 10B each show a first example of use of a pierced earring serving as an ornament according to the present invention. An annular hook 6 (mounting portion) for a spherically shaped ornament body 7 (auxiliary ornament member) other than the ornament portion 19*a* of the pierced earring 19 (main body) and a C-shaped hooking member 8 (auxiliary fixing member) other than the pierced earring fastener 1 is formed on an outer periphery face of the ring 5 (restraining member) of the pierced earring fastener 1 (fastener). This hook 6, as indicated by the virtual line of FIG. 3, is composed of a material (for example, 14KP gold) identical to that for the rings. After the pierced earring fastener 1 has been assembled, this hook 6 is fixed to the ring 5 positioned at the outermost portion by means of brazing or the like.

As shown in FIG. 10A and FIG. 10B, the pin 4 of the pierced earring 19 is inserted into a hole of an earlobe E2 at one side, and is inserted into the through hole 3*a* of the pierced earring fastener 1 at the other side. In this manner, the pin 4 is sandwiched between the cylinder bodies 2*a*' and 2*a*', and is fixed. At this time, movement of the cylinder body 2*a*' is restricted by means of a restraining force of the ring 5, and an elastic reactive force of the holder 3 is enhanced. Thus, the pierced earring 19 hardly comes off. In addition, a hooking member 8 is pinched and fixed to an external ear E1 therebetween. In this way, the pierced earring 19 is securely fixed at ear E by means of the pierced earring fastener 1 and the hooking member 8, and a risk of coming-off or loss is reduced. Further, an ornament effect is increased by the presence of the ornament portion 19*a* (front portion of the pierced earring) and the ornament body 7 (back portion of the pierced earring) of the pierced earring 19. The ornament body 7 and the hooking member 8 may be made of metal, resin, rubber or the like.

Figure 11A:
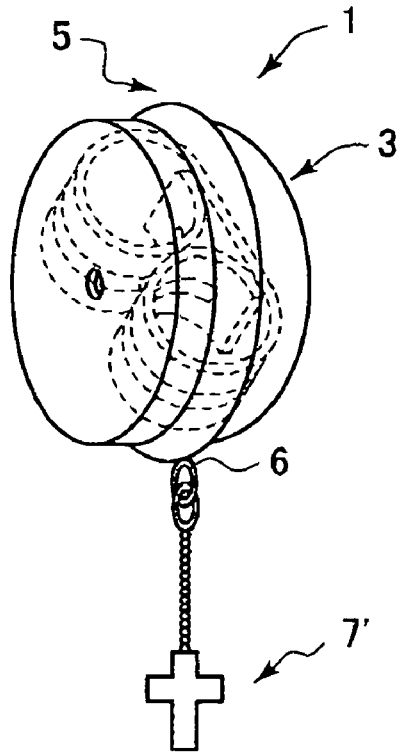
FIG. 11A is an illustrative perspective view illustrating a modified example of a pierced earring fastener that can be used in FIG. 10A.
Figure 11B:
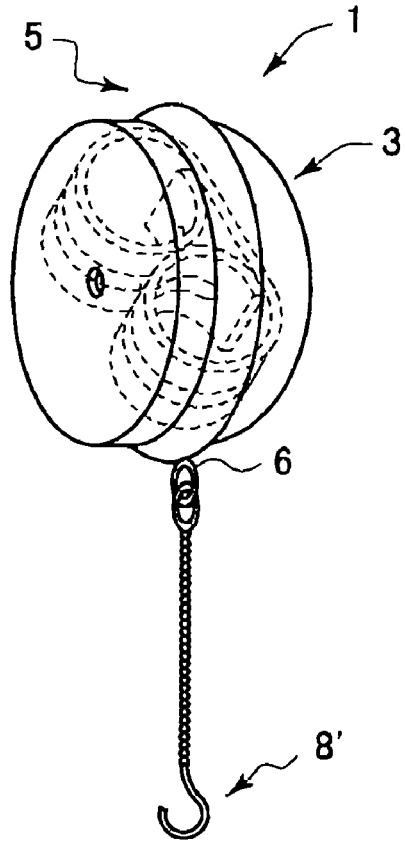
FIG. 11B is an illustrative perspective view illustrating another modified example of a pierced earring fastener that can be used in FIG. 10A.

FIG. 11A and FIG. 11B each show a modified example of a pierced earring fastener that can be used in FIG. 10 and FIG. 10B. In FIG. 11A, only a cross-shaped ornament body 7' (auxiliary ornament member) other than the pierced earring 19 (refer to FIG. 10A) is mounted on a hook 6. In FIG. 11B, only the hook-shaped hooking member 8' (auxiliary ornament member) other than the pierced earring 19 (refer to FIG. 10A) is mounted on the hook 6.

Figure 12A:
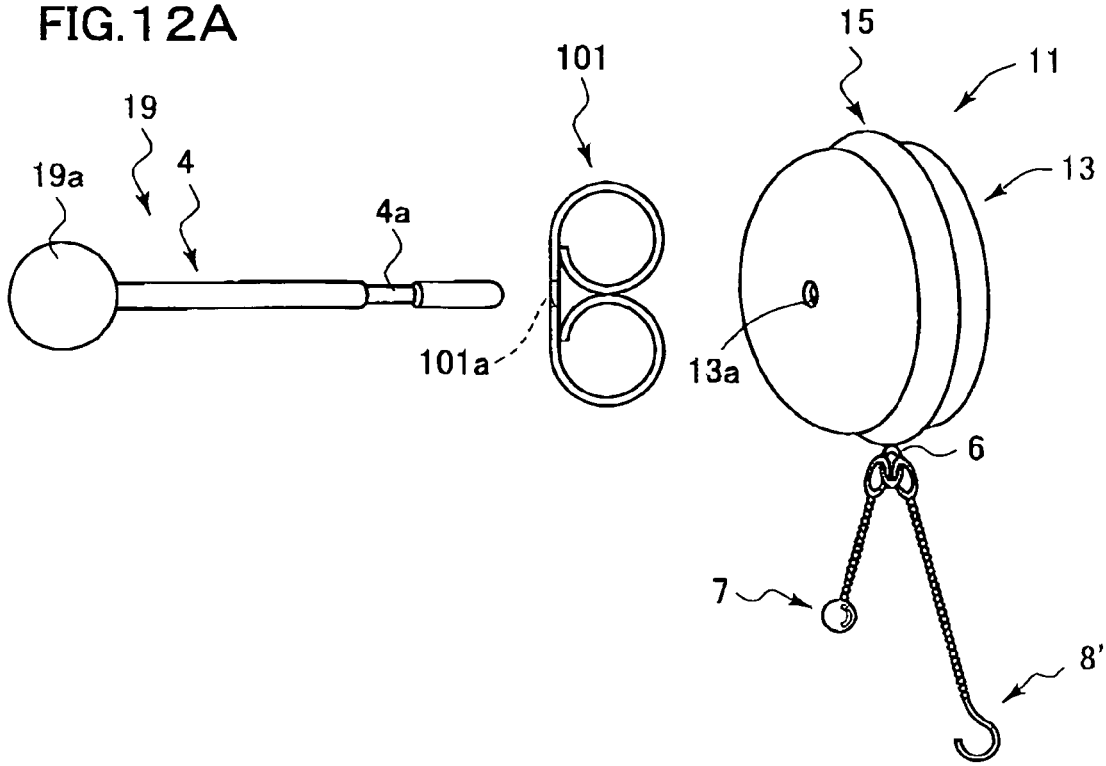
FIG. 12A is an illustrative perspective view illustrating a second use example of a pierced earring.
Figure 12B:
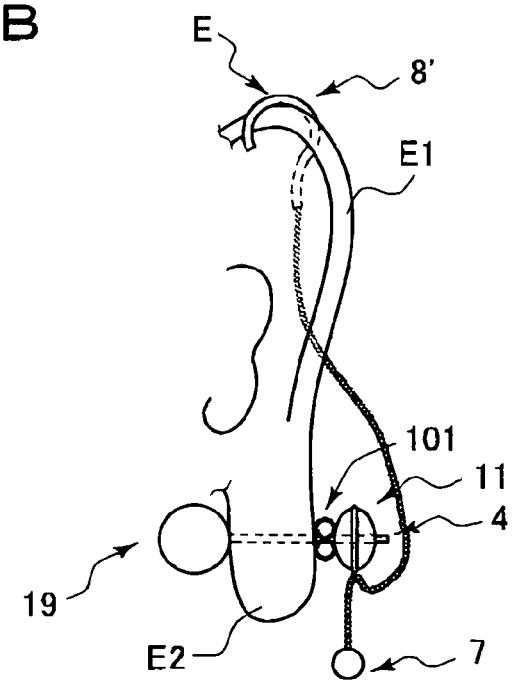
FIG. 12B is an illustrative view of wearing illustrating the second use example of the pierced earring.

FIG. 12A and FIG. 12B each show a second use example of a pierced earring. An annular hook 6 (mounting portion) for mounting the spherical ornament 7 (auxiliary ornament member) other than the ornament portion 19*a* of the pierced earring 19 (main body) and a hook-shaped hooking member 8' (auxiliary fixing member) other than the pierced earring fastener 11 is formed on an outer periphery face of the ring 15 (restraining member) of the pierced earring fastener 11 (fastener) shown in FIG. 12A. In addition, a fixing device 101

(fastener) other than the pierced earring fastener 11 having a through hole 101*a* in an axial direction is provided. The pin 4 of the pierced earring 19 is fixed and retained to the fixing device 101 and the pierced earring fastener 11.

Figure 18:
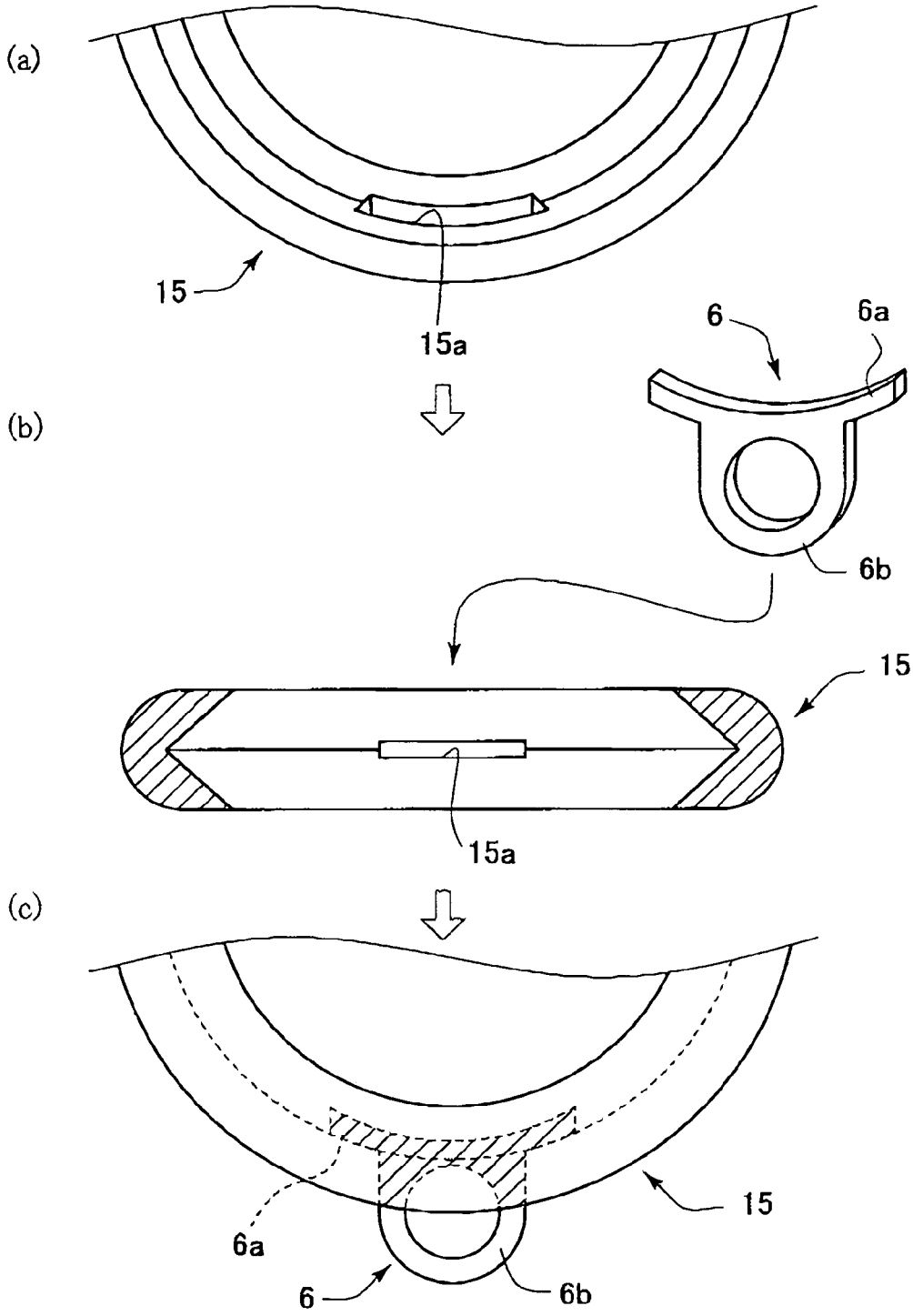
FIG. 18 is a illustrative process flow chart illustrating a method for mounting a hook that is an essential portion shown in FIG. 12A.

FIG. 18 shows a method for mounting a hook 6 that is an essential portion of FIG. 12A. On the circumferential face of the ring 15 having a protrusive mountain-like shaped (inverted V-shaped) cross section (refer to step (b)) toward the outside, an elongated through hole 15*a* is formed in the circumferential direction (step (a)). On the other hand, a flange portion 6*a* that is longer than the circumferential length of the elongated through hole 15*a* and a mounting ring portion 6*b* are formed on the hook 6. When the ring portion 6*b* of the hook 6 is inserted through the inner periphery face side of the ring 15*a* (step (b)), the flange portion 6*a* of the hook 6 is supported on the inner periphery face of the ring 15 (step (c)). As in FIG. 17A, when the holder 13 is engaged into the ring 15, the flange portion 6*a* of the hook 6 is pinched and retained under pressure on an inner face of the ring 15 and an outer face of the holder 13.

As shown in FIG. 12A and FIG. 12B, the pin 4 of the pierced earring 19 is inserted into a hole of earlobe E2 at one side, and then, is inserted into a through hole 101*a* of a fixing device 101 and the through hole 13*a* of the pierced earring fastener 11 at the other side. Then, the pin 4 is pinched and fixed to the holder 13. At this time, an elastic reactive force of the holder 13 is enhanced by means of a restraining force of a ring 15, and thus, the pierced earring 19 hardly comes off. In addition, the hooking member 8' is pinched and fixed to external ear E1. In this way, the pierced earring 19 is securely fixed to ear E by means of the fixing device 101, the pierced earring fastener 11, and the hooking member 8', and a risk of coming-off or loss is reduced. In this case, a primary function of the pierced earring fastener 11 is to retain and fix the ornament body 7 and the hooking member 8'. In addition, an ornament effect is increased by the presence of the ornament portion 19*a* (front portion of the pierced earring) and the ornament body 7 (back portion of the pierced earring) of the pierced earring 19. The ornament body 7 and the hooking member 8' may be made of metal, resin, rubber or the like.

Figure 13A:
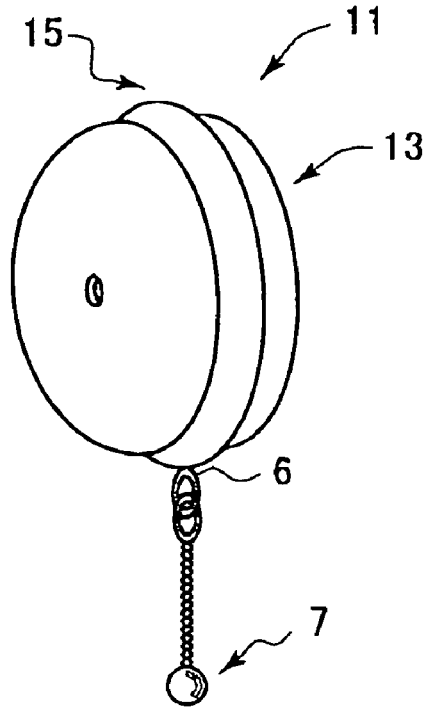
FIG. 13A is an illustrative perspective view illustrating a modified example of a pierced earring fastener that can be used in FIG. 12A.
Figure 13B:
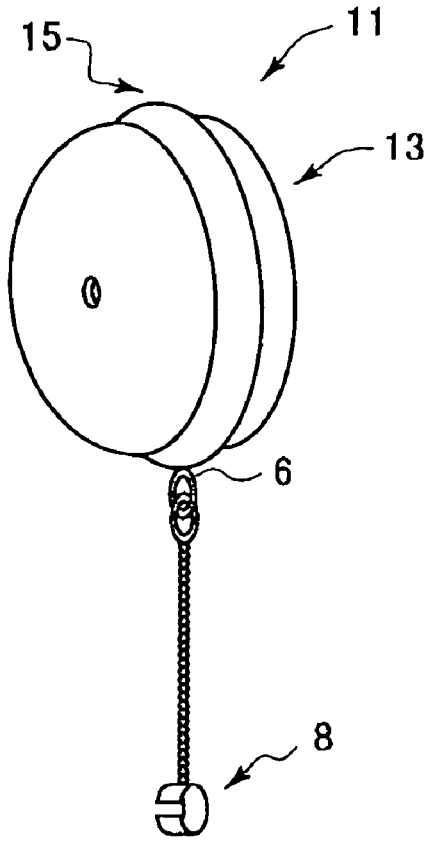
FIG. 13B is an illustrative view of wearing illustrating a modified example of the pierced earring fastener that can be used in FIG. 12A.

FIG. 13A and FIG. 13B each show a modified example of a pierced earring fastener that can be used in FIG. 12A and FIG. 12B. In FIG. 13A, only the spherical ornament body 7 (auxiliary ornament member) other than the pierced earring 19 (refer to FIG. 12A) is mounted on a hook 6. In FIG. 13B, only the C-shaped hooking member 8 (auxiliary ornament member) other than the pierced earring 19 (refer to FIG. 12A) is mounted on the hook 6.

Figure 16:
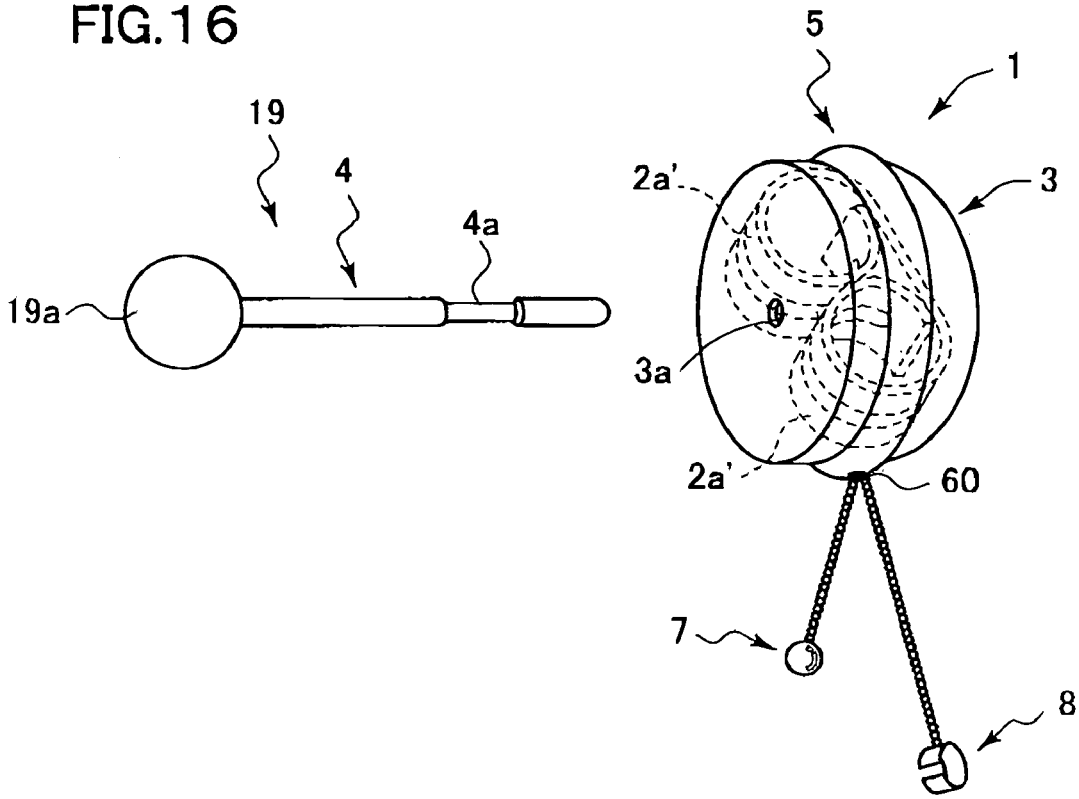
FIG. 16 is an illustrative perspective view illustrating a third use example of a pierced earring.

FIG. 16 shows a third use example of a pierced earring. On the outer periphery face of the ring 5 (restraining member) of the pierced earring fastener 1 (fastener) shown in FIG. 16, the spherical ornament body 7 (auxiliary ornament member) other than the ornament portion 19*a* of the pierced earring 19 (main body) and the C-shaped hooking member 8 (auxiliary fixing member) other than the pierced earring fastener 1 are directly fixed to each other by means of brazing 60 or the like.

Figure 14A:
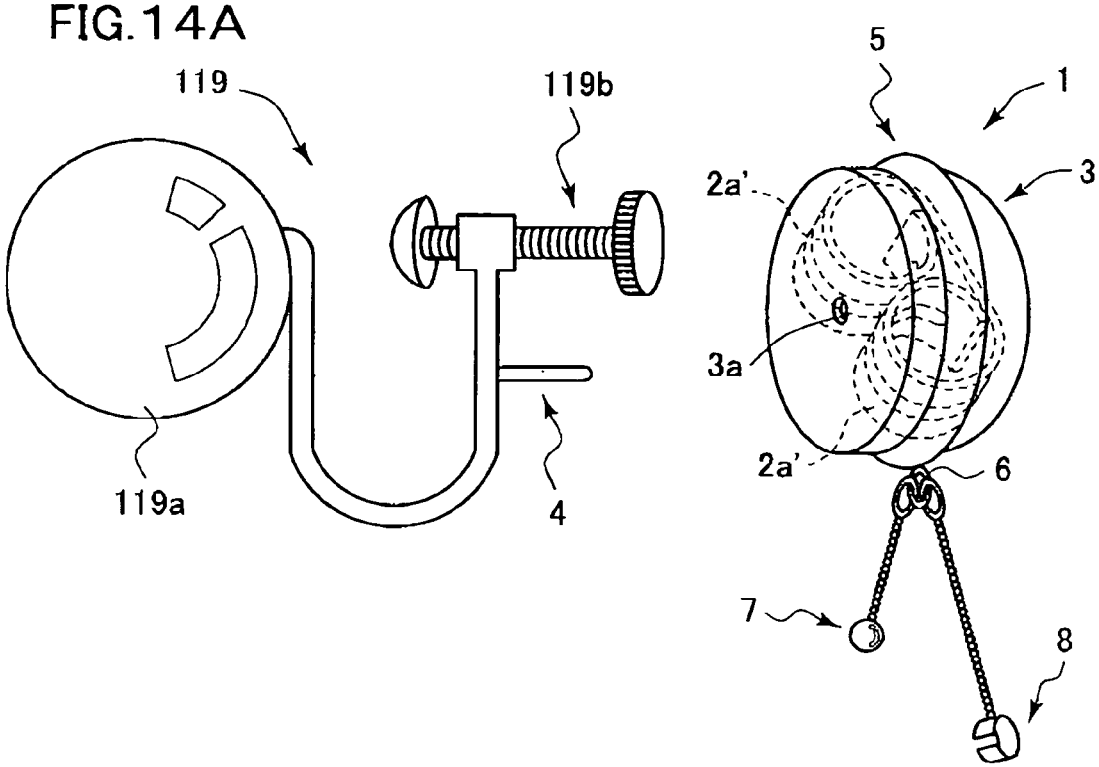
FIG. 14A is an illustrative perspective view illustrating a first use example of an unpierced earring serving as an ornament according to the present invention.
Figure 14B:
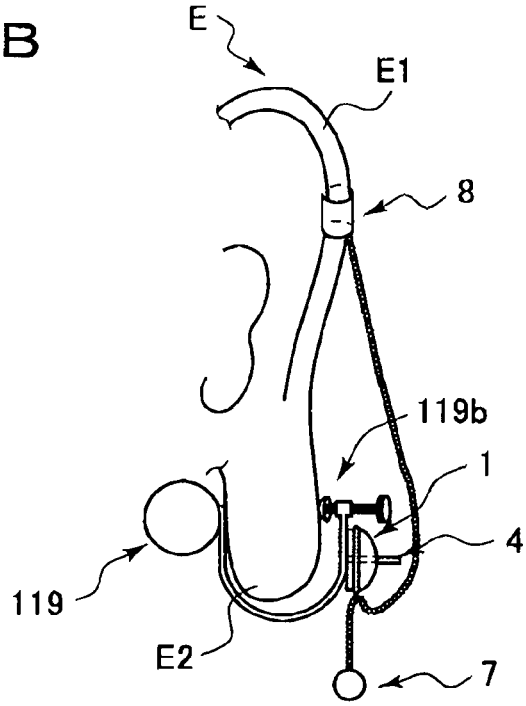
FIG. 14B is an illustrative view of wearing illustrating the first use example of the unpierced earring serving as the ornament according to the present invention.

FIG. 14A and FIG. 14B each show a first use example of an unpierced earring serving as an ornament according to the present invention. An annular hook 6 (mounting portion) for mounting the spherical ornament body 7 (auxiliary ornament member) other than a ornament portion 119*a* of an unpierced earring 119 (main body) and the C-shaped hooking member 8 (auxiliary fixing member) other than the pierced earring fastener 1 is formed on the outer periphery of the ring 5 (restraining member) of the pierced earring fastener 1 (fastener) shown in FIG. 14A. The unpierced earring 119 is pinched on earlobe E2 by means of a screw tightening member 119*b*.

As shown in FIG. 14A and FIG. 14B, the pin 4 of the unpierced earring 119 is inserted into the through hole 3*a* of the pierced earring fastener 1 and the pin 4 is pinched between the cylinder bodies 2*a*' and 2*a*'. At this time, movement of the cylinder body 2*a*' is restricted by means of a restraining force of the ring 5, an elastic reactive force of the holder 3 is enhanced, and thus, the unpierced earring 119 hardly comes off. In addition, the hooking member 8 is pinched and fixed to external ear E1. In this way, the unpierced earring 119 is securely fixed to ear E by means of the pierced earring fastener 1 and the hooking member 8, and a risk of coming-off or loss is reduced. Further, an ornament effect is increased by the presence of the ornament portion 119*a* (front portion of the pierced earring) of the unpierced earring 119 and the ornament body 7 (back portion of the pierced earring). The ornament body 7 and the hooking member 8 may be made of any of metal, resin, rubber or the like, and a mount position of the pin 4 may be any position other than that shown in the figures.

Figure 15A:
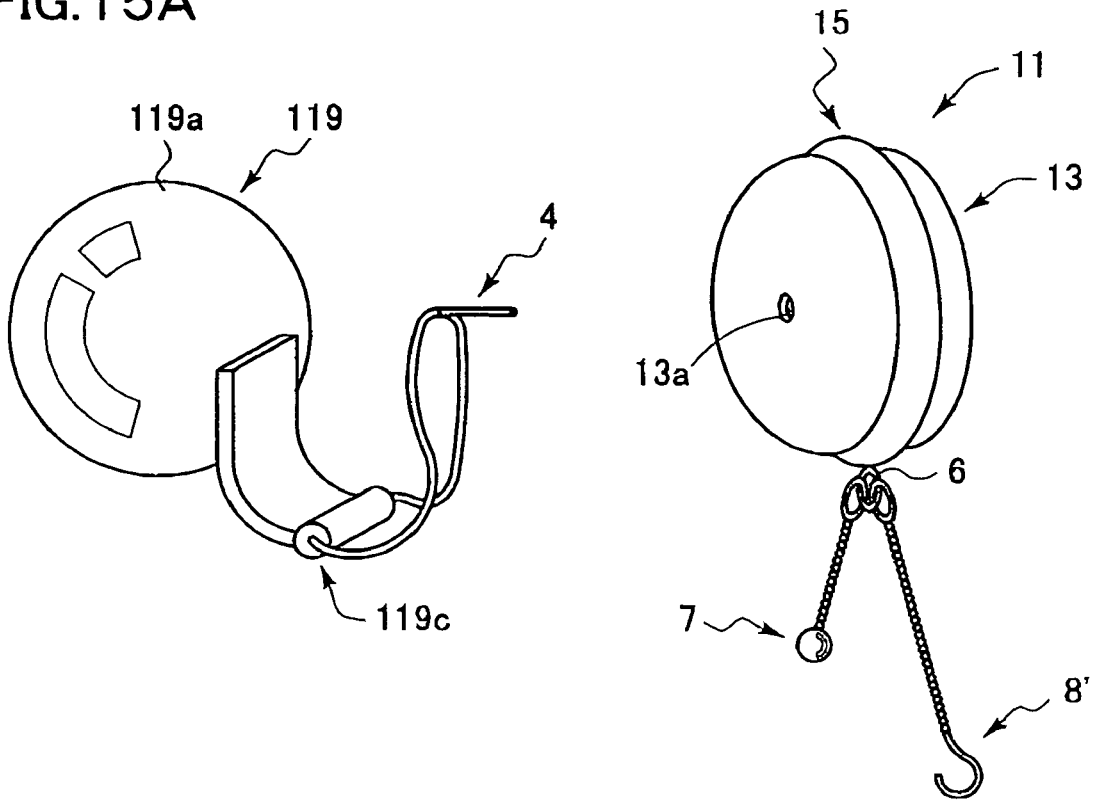
FIG. 15A is an illustrative perspective view illustrating a second use example of an unpierced earring.
Figure 15B:
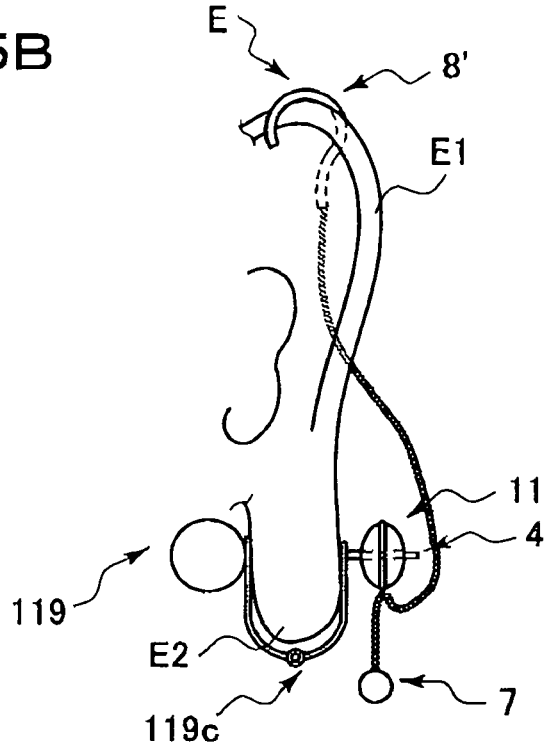
FIG. 15B is an illustrative view of wearing illustrating the second use example of the unpierced earring.

FIG. 15A and FIG. 15B shows a second use example of an unpierced earring. An annular hook 6 (mounting portion) for mounting the spherical ornament body 7 (auxiliary ornament member) other than the ornament portion 119*a* of the unpierced earring 119 (main body) and the hook-shaped hooking member 8' (auxiliary fixing member) other than the pierced earring fastener 11 is formed on the outer periphery face of the ring 15 (restraining member) of the pierced earring fastener 11 shown in FIG. 15A. The unpierced earring 119 is pinched at earlobe E2 by means of a spring member 119*c*.

As shown in FIG. 15A and FIG. 15B, the pin 4 of the unpierced earring 119 is inserted into the through hole 13*a* of the pierced earring fastener 11, and then,the pin 4 is pinched and fixed to the holder 13. At this time, an elastic reactive force of the holder 13 is enhanced by means of a restraining force of the ring 5, and thus, the unpierced earring 119 hardly comes off. In addition, the hooking member 8' is pinched and fixed to external ear E1. In this way, the unpierced earring 119 is securely fixed to ear E by means of the pierced earring fastener 11 and the hooking member 8', and a risk of coming-off or loss is reduced. Further, an ornament effect is increased by the presence of the ornament portion 119*a* (front portion of the pierced earring) and the ornament body 7 (back portion of the pierced earring) of the unpierced earring 119. The ornament body 7 and the hooking member 8' may be made of a metal, a resin, a rubber, or the like, and a mount position of the pin 4 may be any position other than that shown in the figure.

While, in the foregoing description, an explanation has been furnished with respect to embodiments of only a pierced earring or an unpierced earring, the present invention can also be applied to a broach, a necklace, a bracelet, or an anklet and the like.

Figure 19A:
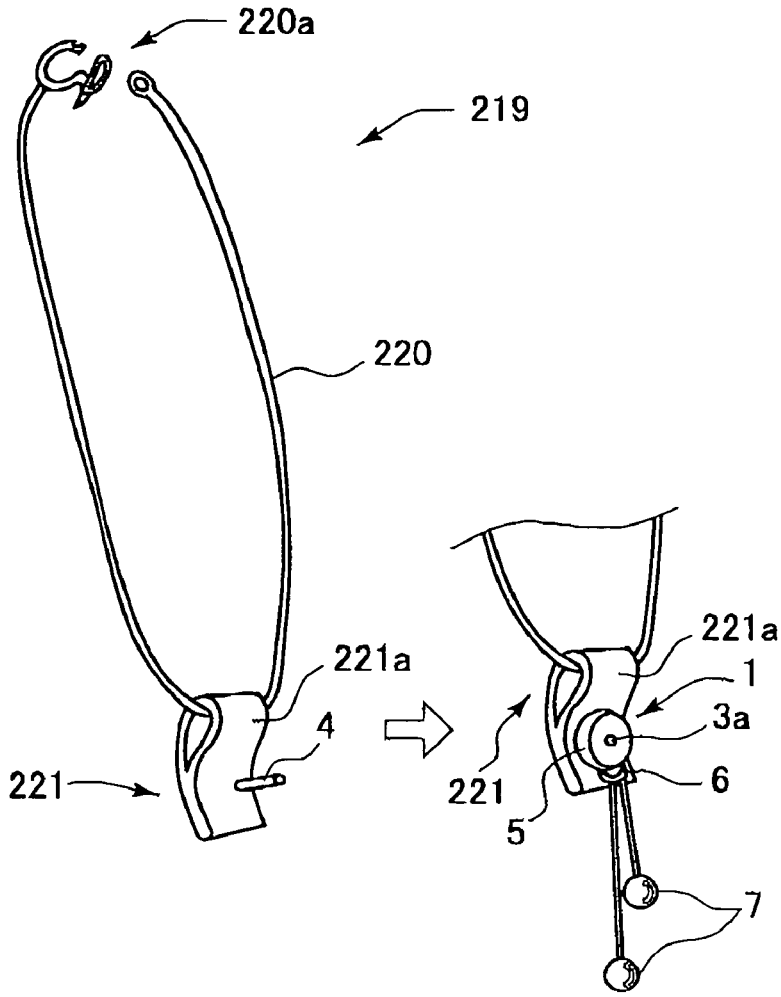
FIG. 19A is an illustrative perspective view illustrating a first use example of a necklace serving as an ornament according to the present invention.
Figure 19B:
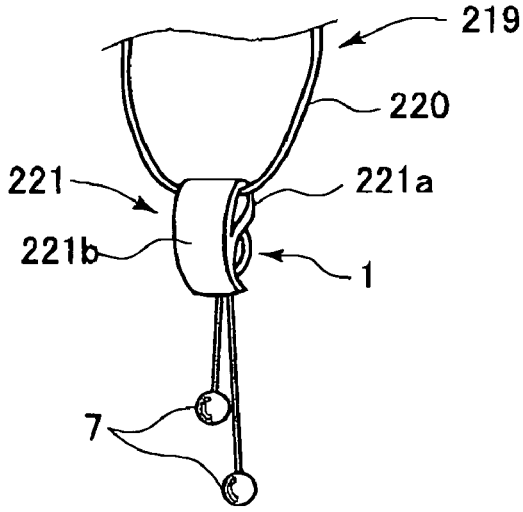
FIG. 19B is an illustrative view of wearing illustrating the first use example of the necklace serving as the ornament according to the present invention.

For example, FIG. 19A and FIG. 19B each show a first use example of a necklace serving as an ornament according to the present invention. In a necklace 219 (ornament) shown in FIG. 19A and FIG. 19B, the ring portion 221*a* of the pendant 221 (main body) is inserted into the ring portion 220 formed in a chain, wire, or rope shape, and then, the inserted ring portion is suspended and retained. When in use, the pin 4 (shaft-shaped member or pinched portion) erected on the pendant 221 is inserted into the through hole 3*a* of the fastener 1, and then, the fastener 1 is fixed (retained) onto the pendant 221 (necklace 219). Reference numeral 220*a* denotes an openable and closable device of the ring body 220.

At the time of wearing on neck, when the ornament portion 221*b* of the pendant 221 is oriented to a forward side, the fastener 1 is positioned rearward (back side) of the pendant 221 (refer to FIG. 19B). In addition, an annular hook 6 (mounting portion) for mounting one or a plurality of (for example, two) the spherical ornament bodies 7 (auxiliary ornament member) other than the ornament portion 221*b* of the pendant 221 is formed on the outer periphery face of the ring 5 (restraining member) of the fastener 1.

Figure 20A:
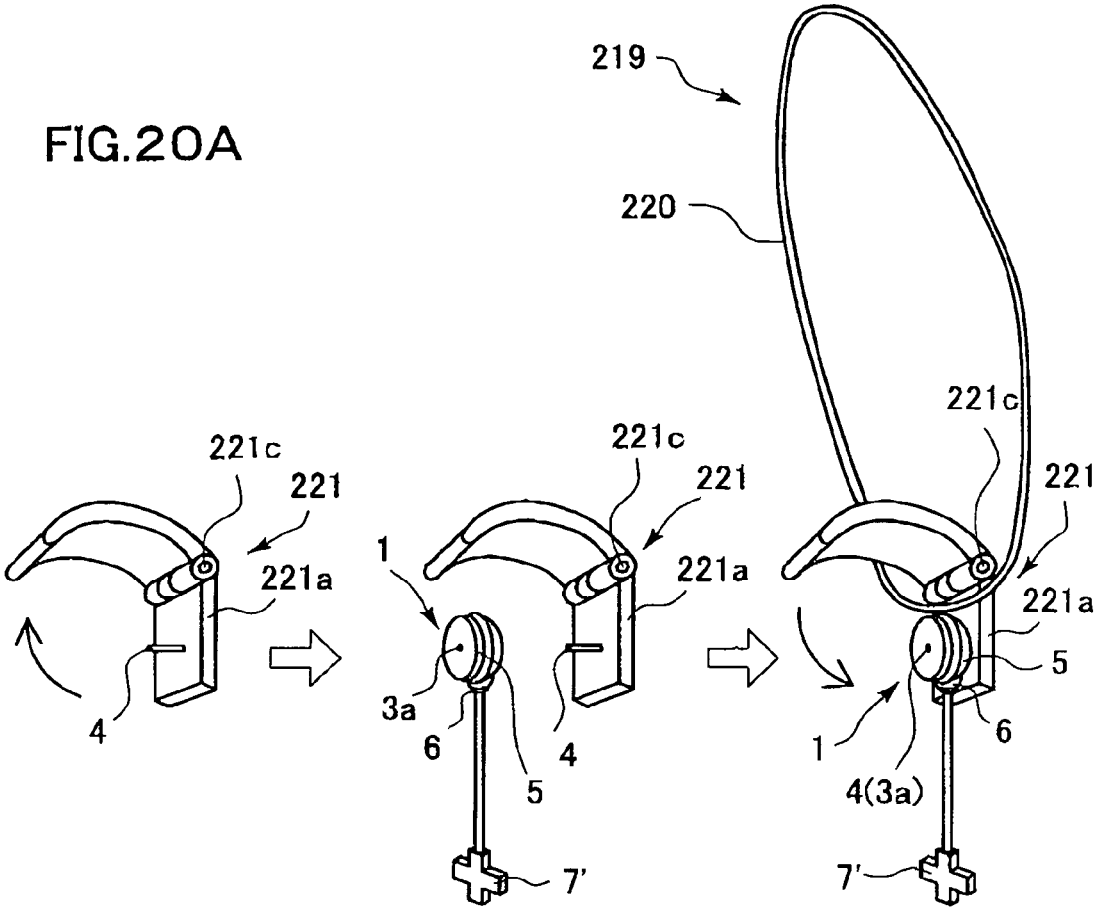
FIG. 20A is an illustrative perspective view illustrating a second use example of a necklace.
Figure 20B:
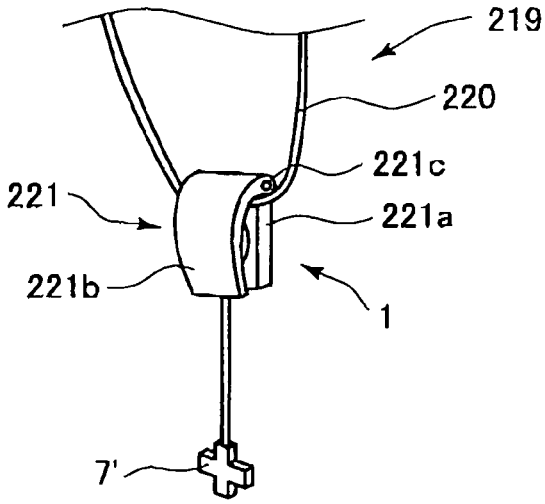
FIG. 20B is an illustrative view of wearing illustrating the second use example of the necklace.

FIG. 20A and FIG. 20B each show a second use example of a necklace serving as an ornament according to the present invention. As shown in FIG. 20A and FIG. 20B, when in use, the necklace 219 (ornament) has the open and close type ring portion 221*a* of the pendant 221 (main body) opened around the pivotal shaft 221*c*. The pin 4 (shaft-shaped member or pinched portion) erected inside of the pendant 221 is inserted into the through hole 3*a* of the fastener 1, and then, the fastener 1 is fixed to the pendant 221. When the ring portion 221*a* of the pendant 221 is inserted into the chain, wire, or rope-shaped ring body 220, and then, is closed, the pendant 221 is suspended and retained on the ring body 220.

At the time of wearing on neck, when the ornament portion 221*b* of the pendant 221, facing to a forward side, is closed, the fastener 1 is positioned rearward (back side) of the pendant 221 (refer to FIG. 20B). In addition, an annular hook 6 (mounting portion) for mounting one or a plurality (for example, one) of the cross-shaped ornament bodies 7' (auxiliary ornament member) other than the ornament portion 221*b* of the pendant 221 is formed on the outer periphery face of the ring 5 (restraining member) of the fastener 1.

Figure 21A:
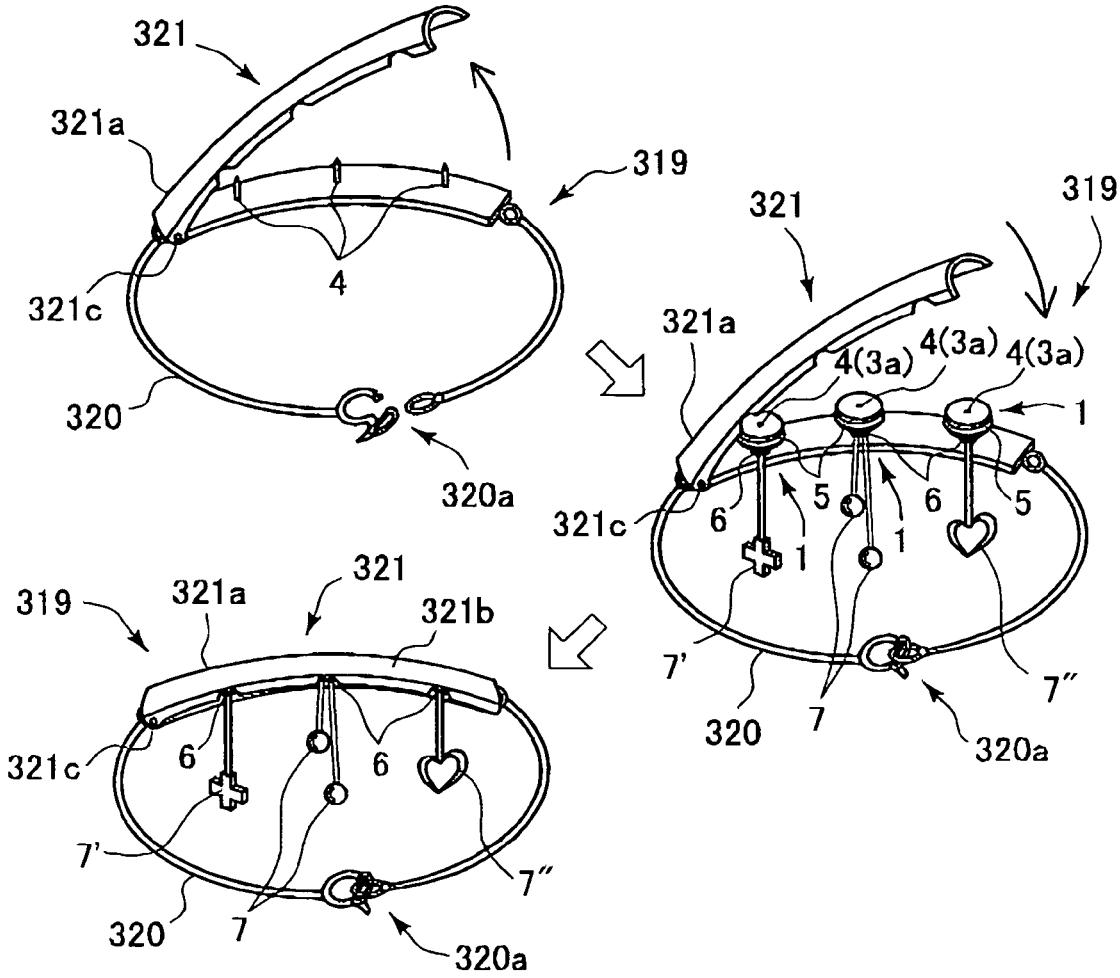
FIG. 21A is an illustrative perspective view illustrating a use example of a bracelet serving as an ornament according to the present invention.
Figure 21B:
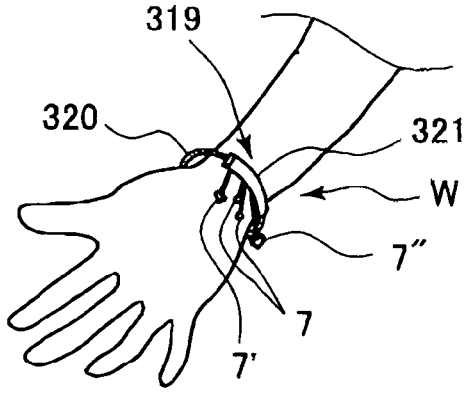
FIG. 21B is an illustrative view of wearing illustrating a use example of the bracelet serving as the ornament according to the present invention.

FIG. 21A and FIG. 21B each show a use example of a bracelet serving as an ornament according to the present invention. A bracelet 319 (ornament), shown in FIG. 21A and FIG. 21B, has a part of a chain, wire, or rope-shaped ring body 320 comprised of a fixing portion 321 (main body) for mounting the fastener 1. When in use, an open and close type cap 321*a* of the fixing portion 321 is opened around a pivotal shaft 321*c*. A plurality of (for example, three) the pins 4 (shaft-shaped member or pinched portion) erected inside of the fixing portion 321 are each inserted into the through hole 3*a* of the fastener 1 having the same number of the above pins. Reference numeral 320*a* denotes an openable and closable device of the ring-shaped body 320.

At the time of wearing on wrist W, when the cap 321*a* is closed so that an ornament portion 321*b* of the fixing portion 321 is oriented to the outside, the fixing device 1 is positioned inwardly (back side) of the fixing portion 321 (refer to FIG. 21A). In addition, an annular hook 6 (mounting portion) for mounting the spherical ornament body 7 (auxiliary ornament member) other than the ornament portion 321*b* of the fixing portion 321, the cross-shaped ornament body 7' (auxiliary ornament member), and a heart-shaped ornament body 7" (auxiliary ornament member) is formed on the outer periphery face of the ring 5 (restraining member) of each fastener 1. Then, these ornament bodies 7, 7' and 7" are suspended and retained so as to be exposed from a side part of the cap 321*a* of the fixing portion 321.

Figure 22A:
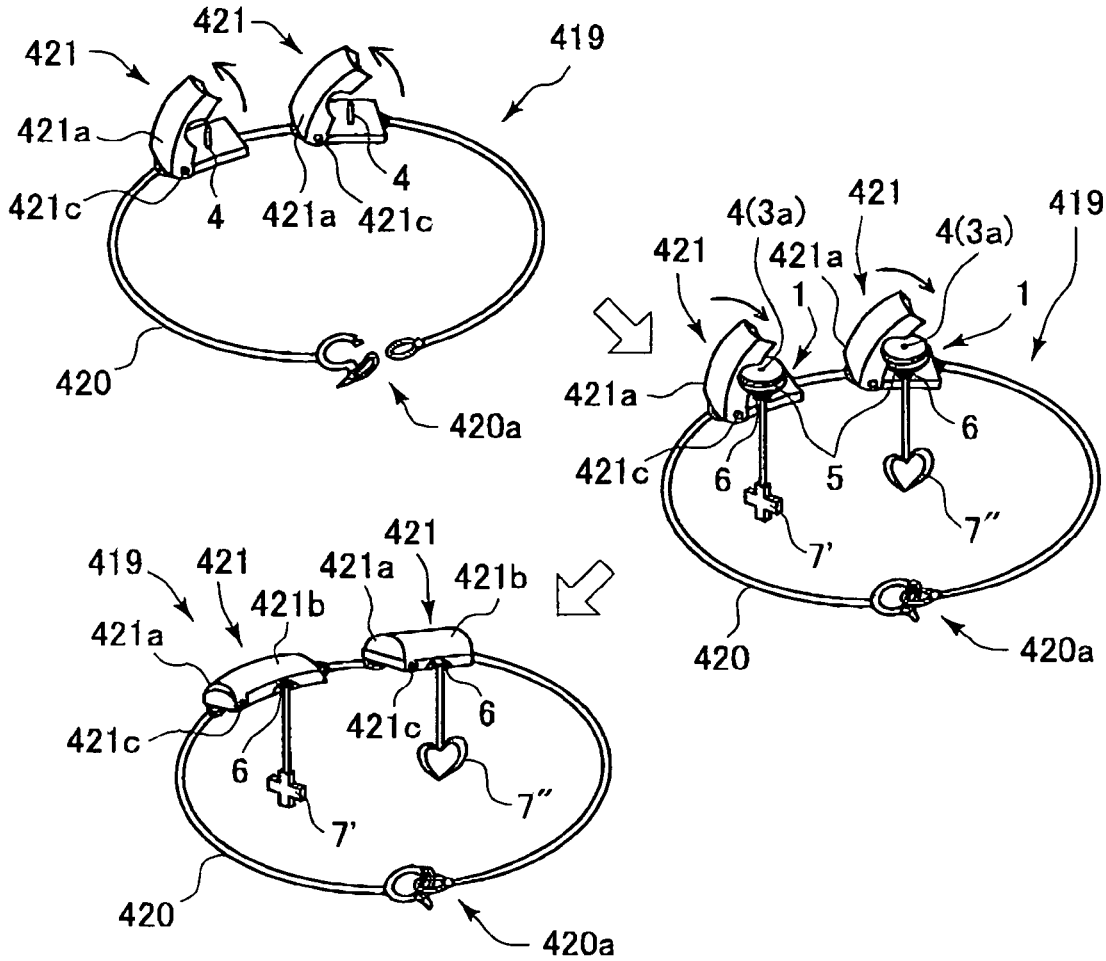
FIG. 22A is an illustrative perspective view illustrating a use example of an anklet serving as an ornament according to the present invention.
Figure 22B:
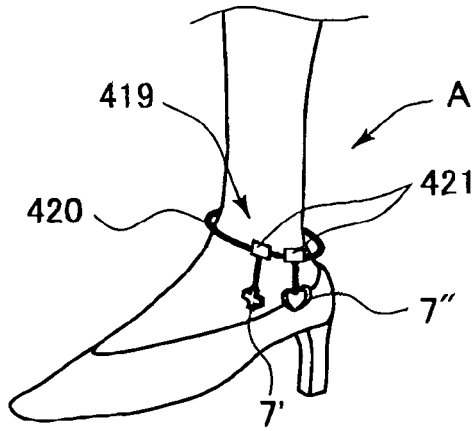
FIG. 22B is an illustrative view of wearing illustrating a use example of the anklet serving as the ornament according to the present invention.

FIG. 22A and FIG. 22B each show a use example of an anklet serving as an ornament according to the present invention. An anklet 419 (ornament), shown in FIG. 22A and FIG. 22B, has a part of a chain, wire, or rope-shaped ring body 421 comprised of a plurality of (for example, two) the fixing portions 421 (main body) for mounting the fastener 1. When in use, an open and close type cap 421*a* of the fixing portion 421 is opened around a pivotal shaft 421*c*. The pins 4 (shaft-shaped member or pinched member) erected inside of the fixing portion 421 are respectively inserted into the through hole 3*a* of the fastener 1. Reference numeral 421*a* denotes an openable and closable device of a ring body 420.

At the time of mounting on ankle A, the cap 421*a* is closed so that an ornament portion 421*b* of the fixing portion 421 is oriented to the outside, and thus, the fastener 1 is positioned inwardly (backside) of the fixing portion 421 (refer to FIG. 22A). In addition, an annular hook 6 (mounting portion) for mounting the cross-shaped ornament body 7' (auxiliary ornament member) and the heart-shaped ornament body 7" (auxiliary ornament member) other than the ornament portion 421*b* of the fixing portion 421 is formed on the outer periphery face of the ring 5 (restraining member) of each fastener 1. Then, these ornament bodies 7' and 7" are suspended and retained so as to be exposed from a side part of the cap 421*a* of the fixing portion 421.

Figure 23A:
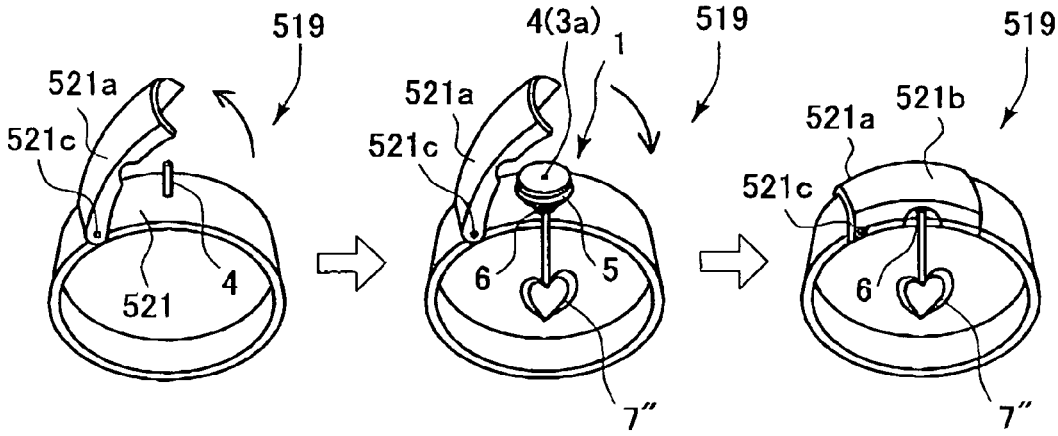
FIG. 23A is an illustrative perspective view illustrating a use example of a finger ring serving as an ornament according to the present invention.
Figure 23B:
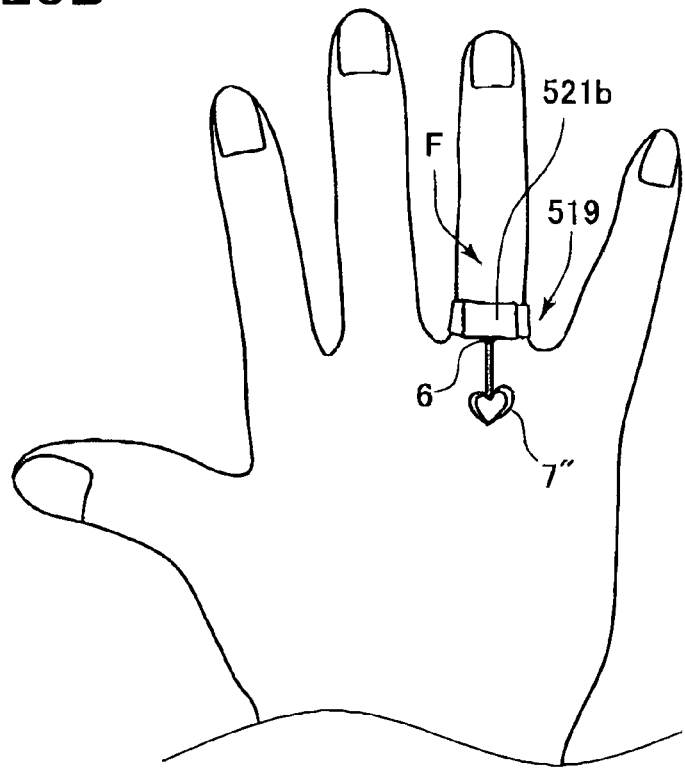
FIG. 23B is an illustrative view of wearing illustrating a use example of the finger ring serving as the ornament according to the present invention.

FIG. 23A and FIG. 23B each show a use example of a finger ring serving as an ornament according to the present invention. A finger ring 519 (ornament), shown in FIG. 23A and FIG. 23B, has a part thereof configured on a base 521 (main body) for mounting the fastener 1. When in use, an open and close type cap 521*a* of the base 521 is opened around a pivotal shaft 521*c*. The pins 4 (shaft-shaped member or pinched portion) erected on the base 521 are respectively inserted into the through hole 3*a* of the fastener 1.

At the time of wearing on finger F, when the cap 521*a* is closed so that an ornament portion 521*b* is oriented to the outside, the fastener 1 is positioned inwardly (back side) of the cap 421*a* (refer to FIG. 23A). In addition, an annular hook 6 (mounting portion) for mounting one or plurality of (for example, one) the heart-shaped ornament bodies 7" (auxiliary ornament member) other than the ornament portion 521*b* of the cap 521*a* is formed on the outer periphery face of the ring 5 (restraining member) of the fastener 1. In addition, the ornament body 7" is suspended and retained so as to be exposed from a side part of the cap 521*a*.

Figure 24A:
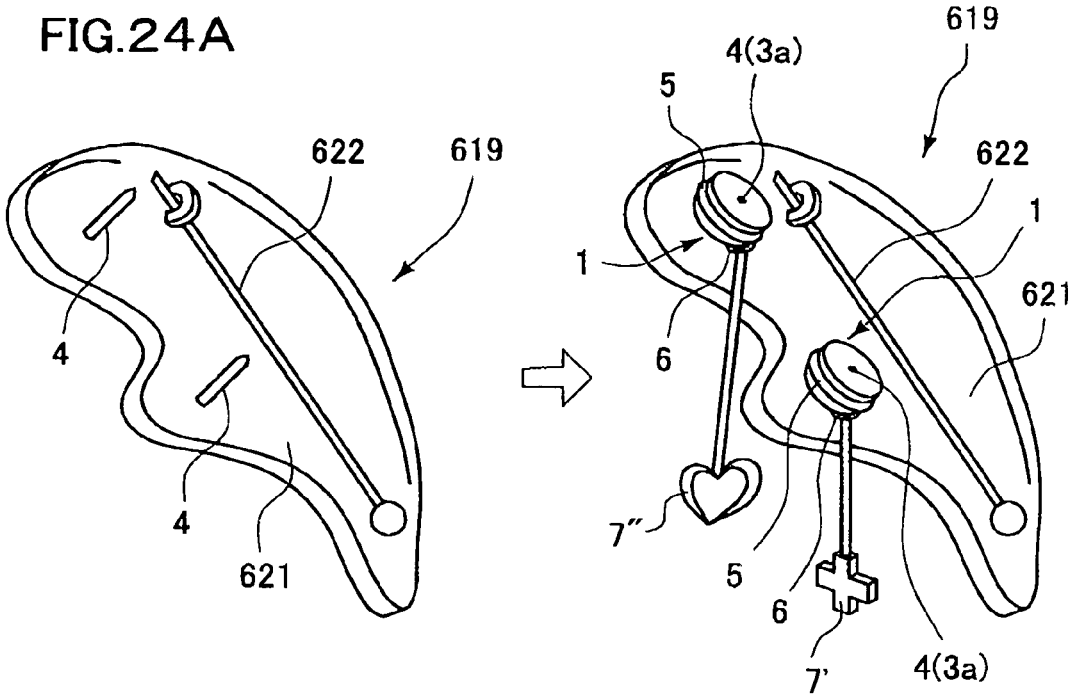
FIG. 24A is an illustrative perspective view illustrating a use example of a broach serving as an ornament according to the present invention.
Figure 24B:
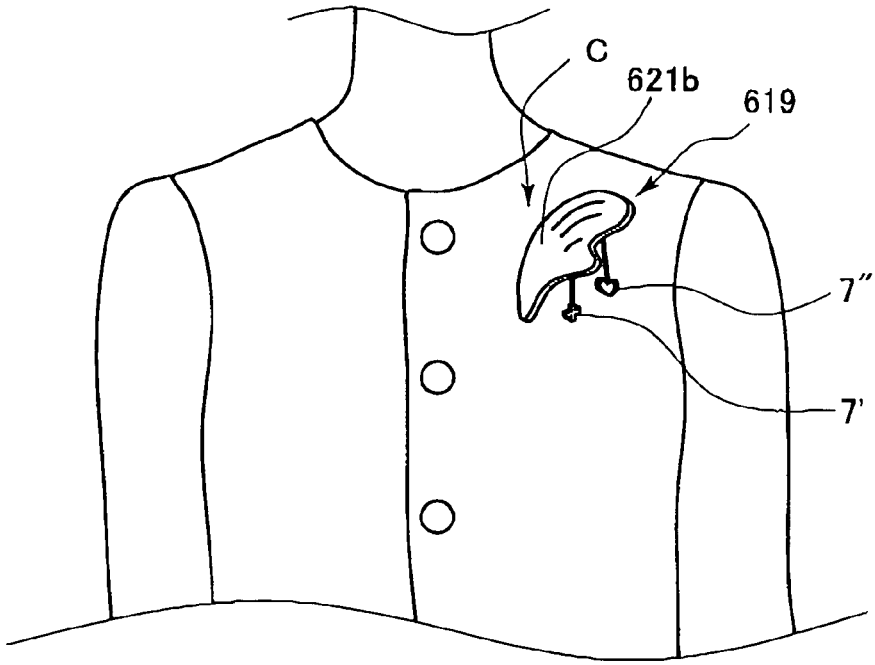
FIG. 24B is an illustrative perspective view illustrating a use example of the broach serving as the ornament according to the present invention.

FIG. 24A and FIG. 24B each show a use example of a broach serving as an ornament according to the present invention. A broach 619 (ornament), shown in FIG. 24A and FIG. 24B, has a back face configured on a base 621 (main body) for mounting the fastener 1. When in use, a plurality of (for example, two) the pins 4 (shaft-shaped member or pinched portion) erected on the base 621 each are inserted into the through hole 3*a* of the fastener 1 whose number is identical to that of the above pins.

At the time of wearing on clothing C by means of the fastening pin 622, when an ornament portion 621*b* is oriented to the outside, the fastener 1 is positioned on a back face (backside) of the broach 619 (refer to FIG. 24B). In addition, an annular hook 6 (mounting portion) for mounting the cross-shaped ornament body 7' (auxiliary ornament member) and the heart-shaped ornament body 7" (auxiliary ornament member) other than an ornament portion 621*b* is formed on the outer periphery face of the ring 5 (restraining member) of each fastener 1. These ornament bodies 7' and 7" are suspended and retained on the broach 619.

Figure 25A:
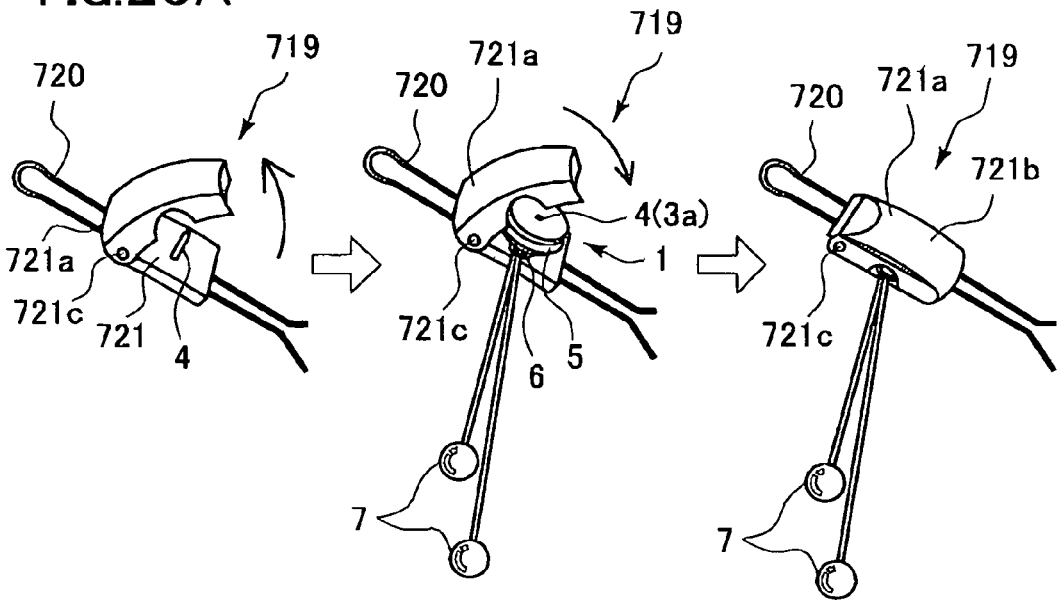
FIG. 25A is an illustrative perspective view illustrating a use example of a hair ornament serving as an ornament according to the present invention.
Figure 25B:
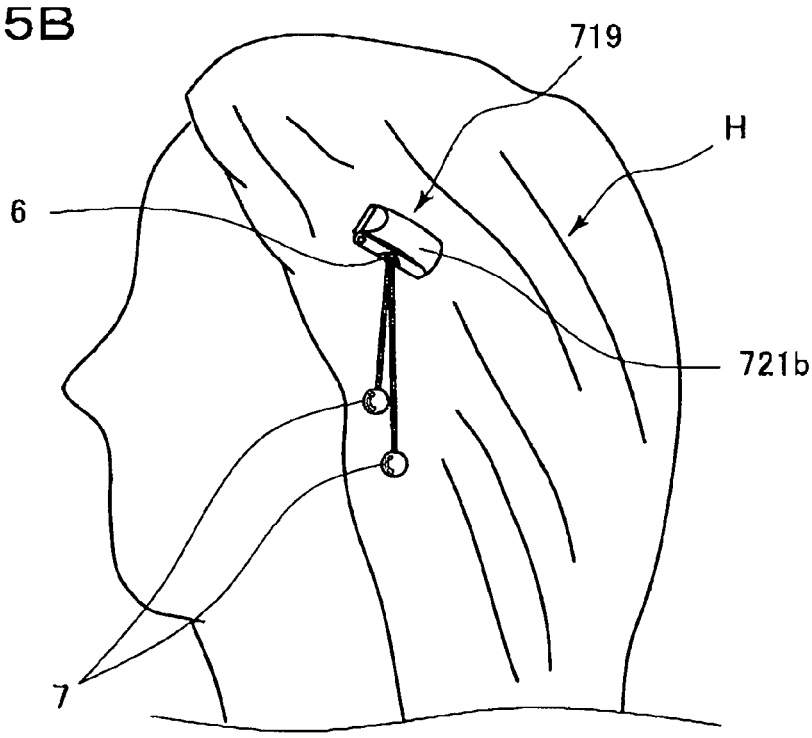
FIG. 25B is an illustrative view of wearing illustrating the use example of the hair ornament serving as the ornament according to the present invention.

FIG. 25A and FIG. 25B each show a use example of a hair ornament serving as an ornament according to the present invention. A hair ornament (ornament), shown in FIG. 25A and FIG. 25B, has a base 721 (main body) for mounting the fastener 1 mounted on a hair fastener 720 (such as hairpin or hair clip) When in use, an open and close type cap 721*a* of the base 721 is opened around a pivotal shaft 721*a*. The pins 4 (shaft-shaped member or pinched portion) erected on the base 721 each are inserted into the through hole 3*a* of the fastener 1.

At the time of wearing on hair H, when the cap 721*a* is closed so that an ornament portion 721*b* is oriented to the outside, the fastener 1 is positioned inwardly (back side) of the cap 721*a* (refer to FIG. 25A) In addition, an annular hook 6 (mounting portion) for mounting one or a plurality of (for example, two) the ornament bodies 7 (auxiliary ornament member) other than the ornament portion 721*b* of the cap

721*a* (in series) is formed on the outer periphery face of the ring 5 (restraining member) of the fastener 1. Further, the ornament body 7 is suspended and retained so as to be exposed from a side part of the cap 721*a*.

Figure 26:
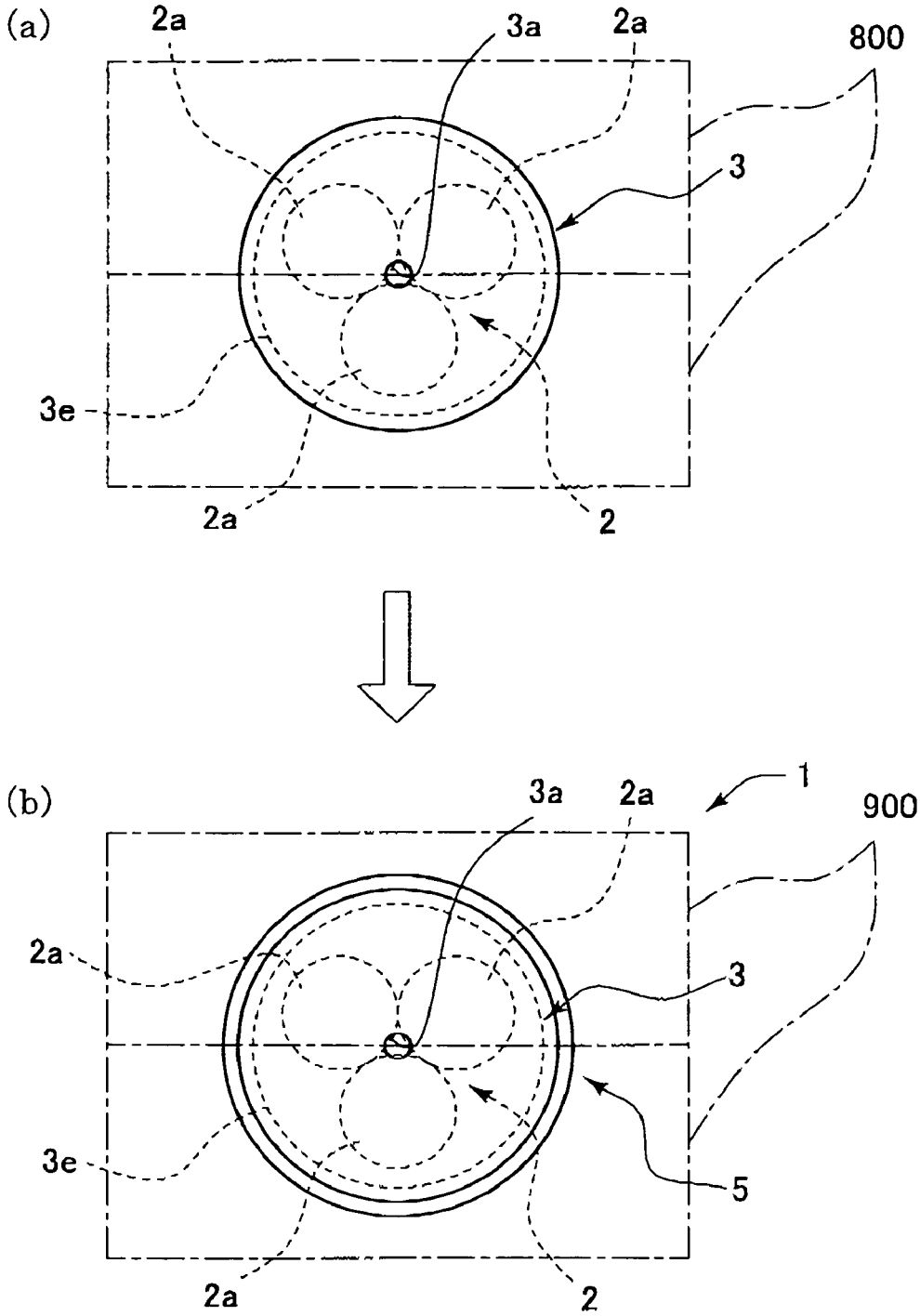
FIG. 26 is an illustrative process flow chart showing another modified example of FIG. 3.

FIG. 26 shows another modified example of FIG. 3. In step (a) of FIG. 26, similarly to in FIG. 17A, the three balls 2*a*, 2*a* and 2*a* (pinching member 2) are inserted into a first die 800, a polymeric material having hardness smaller than that of any of the balls 2*a* and the ring 5 described later is injected and insertion molded, forming the holder 3 (rubber-like elastic member) having the through hole 3*a* in an axial direction, the holder exhibiting a lens shape having a thing center part and a thin peripheral part. After cooling and solidification, in step (b) of FIG. 26, a molded article in step (a) is inserted into a second die 900, and a polymeric material having hardness greater than that of the holder 3 is injected. That is, so called two-color molding is carried out, thereby forming the ring 5 (restraining member) integrally with the holder 3. The polymeric materials used here include a synthetic resin and elastomer (synthetic rubber).

What is claimed is:

1. A fastener comprising:

an elastic member that is formed essentially of rubber or soft synthetic resin, being elastically deformable;

a pinching member that is harder than the elastic member, is capable of being retained at a predetermined position so as to be surroundingly enveloped by the elastic member, and moving in an extending direction with elastic deformation of the elastic member, in a state in which the pinching member is embedded in the elastic member; and a restraining member that has a hardness equal to or greater than that of the elastic member, and is capable of restricting movement of the pinching member in the extending direction and the elastic deformation of the elastic member being caused by the movement of the pinching member, in a state in which at least a part of a periphery of the elastic member is surrounded by the restraining member, and fastening a portion of a ornament indirectly with the elastic member and the pinching member in a state of being non-contiguous with the pinching member, wherein the pinching member is enveloped in the elastic member being non-contiguous with the restraining member, and the portion of the ornament is pinched by the pinching member, thereby restricting and retaining the ornament.

2. The fastener as claimed in claim 1, wherein the pinching member is comprised of a plurality of elements; and wherein the portion of the ornament is directly pinched between the elements of the pinching member or is indirectly pinched by another member, thereby restricting and retaining the ornament.

3. The fastener as claimed in claim 2, wherein a plurality of the elements of the pinching member are arranged in parallel in a state in which two cylinders are coupled integrally with each other or in a state in which the two cylinders are independent of each other; and wherein a part of the ornament is pinched in a gap defined between the cylinders of the pinching member, thereby restricting and retaining the ornament.

4. The fastener as claimed in claim 1, wherein a part of the ornament is a shaft-shaped member; and wherein the restraining member covers the elastic member so as to be surrounded along a circumferential direction of the shaft-shaped member.

5. The fastener as claimed in claim 4, wherein the restraining member covers the elastic member in a ring shape so as to restrict the elastic member in elastically deformable directions.

6. The fastener as claimed in claim 4, wherein the elastic member has a through hole or a bottomed hole so as to permit insertion of the shaft-shaped member.

7. The ornament comprising:

the fastener set forth in claim 1;

a main body; and the portion pinched by the fastener on the main body.

8. The ornament as claimed in claim 7, wherein an auxiliary ornament member other than the main body and/or an auxiliary fixing member other than the fastener is mountable onto the restraining member of the fastener.

9. The ornament as claimed in claim 7, wherein the restraining member of the fastener has a mount section for mounting the auxiliary ornament member other than the main body and/or the auxiliary fixing member other than the fastener.

* * * * *